US010186192B2

(12) United States Patent
Tong et al.

(10) Patent No.: US 10,186,192 B2
(45) Date of Patent: Jan. 22, 2019

(54) PIXEL CIRCUIT AND DRIVING METHOD, AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Zhenxiao Tong, Beijing (CN); Dongmei Wei, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 0 days.

(21) Appl. No.: 15/569,289

(22) PCT Filed: May 19, 2017

(86) PCT No.: PCT/CN2017/085026

§ 371 (c)(1),
(2) Date: Oct. 25, 2017

(87) PCT Pub. No.: WO2018/000982

PCT Pub. Date: Jan. 4, 2018

(65) Prior Publication Data

US 2018/0226019 A1 Aug. 9, 2018

(30) Foreign Application Priority Data

Jun. 30, 2016 (CN) ..... 2016 1 0509888

(51) Int. Cl.
*G09G 3/3291* (2016.01)
*G09G 3/3225* (2016.01)

(52) U.S. Cl.
CPC ..... *G09G 3/3225* (2013.01); *G09G 3/3291* (2013.01); *G09G 2320/0233* (2013.01); *G09G 2320/045* (2013.01)

(58) Field of Classification Search
CPC ..... G09G 3/3225; G09G 3/3233
See application file for complete search history.

(56) References Cited

U.S. PATENT DOCUMENTS 7,557,784 B2 * 7/2009 Kwak ..... G09G 3/3233 345/205
2011/0279433 A1 11/2011 Ryu
2015/0130780 A1 5/2015 Kwon et al.

FOREIGN PATENT DOCUMENTS

CN 101937647 A 1/2011
CN 103366682 A 10/2013
(Continued)

OTHER PUBLICATIONS

International Search Report and Written Opinion dated Jul. 28, 2017; PCT/CN2017/085026.
(Continued)

*Primary Examiner* — Kevin M Nguyen
(74) *Attorney, Agent, or Firm* — Ladas & Parry LLP

(57) ABSTRACT

A pixel circuit and a driving method thereof and a display device. The pixel circuit includes: a first reverse bias unit, and a first sub-pixel circuit and a second sub-pixel circuit adjacent to each other. The first sub-pixel circuit includes a first light-emitting unit; the second sub-pixel circuit includes a second light-emitting unit. The first light-emitting unit is connected with a first drive node and a second bias output node; the second light-emitting unit is connected with a second drive node and a first bias output node; the first reverse bias unit is connected with the first drive node, the second drive node, the second bias output node, the first bias
(Continued)

output node, a first bias control terminal and a second bias control terminal.

23 Claims, 14 Drawing Sheets

(56) References Cited

FOREIGN PATENT DOCUMENTS

| | | | |
|---|---|---|---|
| CN | 103383833 | A | 11/2013 |
| CN | 103383836 | A | 11/2013 |
| CN | 103531148 | A | 1/2014 |
| CN | 103531149 | A | 1/2014 |
| CN | 104252845 | A | 12/2014 |
| CN | 105895028 | A | 8/2016 |
| KR | 1020060053774 | A | 5/2006 |

OTHER PUBLICATIONS

The First Chinese Office Action dated Nov. 27, 2017; Appln. 201610509888.0.

* cited by examiner

PIXEL CIRCUIT AND DRIVING METHOD, AND DISPLAY DEVICE

TECHNICAL FIELD

The present disclosure relates to a pixel circuit, a driving method thereof, and a display device.

BACKGROUND

An organic light-emitting diode (OLED) display has characteristics including lightness and thinness, a wide viewing angle, low power consumption, a fast response speed and others, and thus receives wide attention. The organic light-emitting diode display, as a new generation of display manners, has begun to gradually replace a traditional liquid crystal display (LCD), and is widely used in a mobile phone screen, a computer monitor, a full-color television, and the like. According to different driving modes, an OLED may be classified into a passive matrix organic light-emitting diode (PMOLED) or an active matrix organic light-emitting diode (AMOLED).

For example, in the AMOLED, a simplest pixel circuit includes two thin film transistors (TFT) having a switching function and a capacitor (C) for storing charges. According to the numbers of the TFTs and the number of the capacitors C, the pixel circuit is briefly referred to as a 2T1C pixel driving circuit, that is, a sub-pixel unit in the AMOLED. Using a pixel circuit diagram with the simplest AMOLED as an example, the pixel driving circuit shown in FIG. 1 is just the 2T1C pixel driving circuit, including a data input switching transistor 1, a driving transistor 2, a storage capacitor 3 and an OLED 4. All TFTs used in FIG. 1 are P-type transistors, Vscan is a scanning voltage, Vdata is a data voltage, VDD is a highest reference voltage of the pixel circuit, and VSS is a lowest reference voltage of the pixel circuit. In an existing display technology, the OLED is loaded with different direct current driving voltages by an external reverse bias voltage device, so that the OLED displays brightness and color as desired at different grayscale values. When the Vscan is a low voltage level, the data input switching transistor 1 is turned on, and the data voltage Vdata is connected to the driving transistor 2, and stored on the storage capacitor 3; a voltage on the storage capacitor 3 causes the driving transistor 2 to remain in a turning-on state all the time, and the driving transistor 2 performs direct current biasing on the OLED 4 all the time. If the OLED 4 is in a direct current biased state for a long time, internal ions are polarized to form a built-in electric field, resulting in a constant increase in a threshold voltage of the OLED 4, and a constant decrease in luminance of the OLED 4, which shortens a service life of the OLED 4. Since direct current bias voltages of the OLED 4 under different grayscales are different, an aging degree of each sub-pixel OLED 4 is different, such that an image displayed on a screen is uneven, which affects a display effect.

SUMMARY

In a first aspect, embodiments of the disclosure provide a pixel circuit, comprising: a first reverse bias unit, and a first sub-pixel circuit and a second sub-pixel circuit adjacent to each other, the first sub-pixel circuit including a first light-emitting unit, and the second sub-pixel circuit including a second light-emitting unit; wherein:

the first light-emitting unit is connected with a first drive node, the second light-emitting unit is connected with a first bias output node;

the first reverse bias unit is connected with the first drive node, the first bias output node, and a first bias control terminal; and the first light-emitting unit is configured to emit light under control of a first driving signal, and to output the first driving signal to the first drive node; the first reverse bias unit is configured to output the first driving signal of the first drive node to the first bias output node under control of the first bias control terminal; and the first bias output node is configured to supply a reverse bias voltage to the second light-emitting unit.

For example, the second light-emitting unit is connected with a second drive node and a second bias output node;

the first reverse bias unit is further connected with the second drive node, the second bias output node and a second bias control terminal;

the second light-emitting unit is configured to emit light under control of a second driving signal, and to output the second driving signal to the second bias output node; the first reverse bias unit is further configured to output the second driving signal of the second drive node under control of the second bias control terminal; and the second bias output node is configured to supply a reverse bias voltage to the first light-emitting unit.

For example, the first sub-pixel circuit further includes a first data input unit and a first storage capacitor;

the first data input unit is connected with a first data terminal, a scanning terminal and a first sub-pixel node, and the first data input unit is configured to output a first data signal of the first data terminal to the first sub-pixel node under control of a signal of the scanning terminal;

the first storage capacitor is connected with the first sub-pixel node and a first voltage terminal, and the first storage capacitor is configured to store a voltage level between the first sub-pixel node and the first voltage terminal;

the first light-emitting unit is further connected with the first sub-pixel node and a first light-emitting control node, and the first light-emitting unit is configured to output the first driving signal to the first drive node under control of a signal of the first sub-pixel node, a signal of the first light-emitting control node, and a signal of the second bias output node.

For example, the pixel circuit further comprises a light-emitting control unit; the light-emitting control unit is connected with the first voltage terminal, the first light-emitting control terminal, and the first light-emitting control node; and the light-emitting control unit is configured to output a voltage level of the first voltage terminal to the first light-emitting control node under control of the first light-emitting control terminal.

For example, the second sub-pixel circuit further includes a second data input unit and a second storage capacitor;

the second data input unit is connected with a second data terminal, the scanning terminal and a second sub-pixel node; and the second data input unit is configured to output a second data signal of the second data terminal to the second sub-pixel node under control of the signal of the scanning terminal;

the second storage capacitor is connected with the second sub-pixel node and the first voltage terminal, and the second storage capacitor is configured to store a voltage level between the second sub-pixel node and the first voltage terminal; and the second light-emitting unit is further configured to output the second driving signal to the second drive node under control of a signal of the second sub-pixel node, a signal of a second light-emitting control node and a signal of the first bias output node.

For example, the pixel circuit further comprises a light-emitting control unit; the light-emitting control unit is connected with the first voltage terminal, the second light-emitting control terminal, and the second light-emitting control node; and the light-emitting control unit is configured to output the voltage level of the first voltage terminal to the second light-emitting control node under control of the second light-emitting control terminal.

For example, wherein the second bias output node and the first bias output node are connected with a second voltage terminal; or the pixel circuit further comprises a second reverse bias unit;

the second reverse bias unit is connected with the second bias output node, the first bias output node, the first light-emitting control terminal, the second light-emitting control terminal, and the second voltage terminal; the second reverse bias unit is configured to output a voltage level of the second voltage terminal to the second bias output node under the control of the first light-emitting control terminal; and the second reverse bias unit is further configured to output the voltage level of the second voltage terminal to the first bias output node under the control of the second light-emitting control terminal.

For example, the first data input unit includes a first data input transistor, a gate electrode of the first data input transistor is connected with the scanning terminal, a first terminal of the first data input transistor is connected with the first data terminal and a second terminal of the first data input transistor is connected with the first sub-pixel node.

For example, the light-emitting control unit includes a first light-emitting control transistor; a gate electrode of the first light-emitting control transistor is connected with the first light-emitting control terminal, a first terminal of the first light-emitting control transistor is connected with the first voltage terminal, and a second terminal of the first light-emitting control transistor is connected with the first light-emitting control node.

For example, the second data input unit includes a second data input transistor, a gate electrode of the second data input transistor is connected with the scanning terminal, a first terminal of the second data input transistor is connected with the second data terminal, and a second terminal of the second data input transistor is connected with the second sub-pixel node.

For example, the light-emitting control unit includes a second light-emitting control transistor, a gate electrode of the second light-emitting control transistor is connected with the second light-emitting control terminal, a first terminal of the second light-emitting control transistor is connected with the first voltage terminal, and a second terminal of the second light-emitting control transistor is connected with the second light-emitting control node.

For example, the first reverse bias unit includes a first reverse bias transistor and a second reverse bias transistor; a gate electrode of the first reverse bias transistor is connected with the first bias control terminal, a first terminal of the first reverse bias transistor is connected with the first drive node, a second terminal of the first reverse bias transistor is connected with the first bias output node;

a gate electrode of the second reverse bias transistor is connected with the second bias control terminal, a first terminal of the second reverse bias transistor is connected with the second drive node, and a second terminal of the second reverse bias transistor is connected with the second bias output node; and the first bias control terminal and the second bias control terminal are connected with a same signal control line.

For example, the second reverse bias unit includes a third reverse bias transistor and a fourth reverse bias transistor; a gate electrode of the third reverse bias transistor is connected with the first light-emitting control terminal, a first terminal of the third reverse bias transistor is connected with the second bias output node, and a second terminal of the third reverse bias transistor is connected with the second voltage terminal; and a gate electrode of the fourth reverse bias transistor is connected with the second light-emitting control terminal, a first terminal of the fourth reverse bias transistor is connected with the first bias output node, and a second terminal of the fourth reverse bias transistor is connected with the second voltage terminal.

For example, the third reverse bias transistor and the fourth reverse bias transistor are transistors of a same type, and the first light-emitting control terminal and the second light-emitting control terminal are connected with different signal control lines; or the third reverse bias transistor and the fourth reverse bias transistor are transistors of different types, and the first light-emitting control terminal and the second light-emitting control terminal are connected with a same signal control line.

For example, the first fight-emitting unit includes a first driving transistor and a first organic light-emitting diode, a gate electrode of the first driving transistor is connected with the first sub-pixel node, a first terminal of the first driving transistor is connected with the first light--emitting control node, a second terminal of the first driving transistor is connected with the first drive node and an anode of the first organic light-emitting diode, and a cathode of the first organic light-emitting diode is connected with the second bias output node.

For example, the second light-emitting unit includes a second driving transistor and a second organic light-emitting diode, a gate electrode of the second driving transistor is connected with the second sub-pixel node, a first terminal of the second driving transistor is connected with the second light-emitting control node, a second terminal of the second driving transistor is connected with the second drive node and an anode of the second organic light-emitting diode, and a cathode of the second organic light-emitting diode is connected with the first bias output node.

In a second aspect, embodiments of the disclosure provide a driving method of a pixel circuit, comprising:

executing operations as follows within a first time period of an Nth frame:

controlling a first light-emitting unit of a first sub-pixel circuit to emit light by a first driving signal;

controlling a first reverse bias unit by a first bias control terminal, to conduct a first drive node and a first bias output node, and to transmit the first driving signal of the first drive node to a first bias output node; and controlling the first reverse bias unit by a second bias control terminal, to conduct a second drive node and a second bias output node;

executing operations as follows within a second time period of the Nth frame:

controlling the first light-emitting unit of the first sub-pixel circuit to emit light by the first driving signal;

controlling a second light-emitting unit of a second sub-pixel circuit to emit light by a second driving signal;

controlling the first reverse bias unit by the first bias control terminal; to disconnect the first drive node from the first bias output node; and controlling the first reverse bias unit by the second bias control terminal, to disconnect the second drive node from the second bias output node;

executing operations as follows within a first time period of an (N+1)th frame:

controlling the second light-emitting unit of the second sub-pixel circuit to emit light by the second driving signal;

controlling the first reverse bias unit by the second bias control terminal, to conduct the second drive node and the second bias output node, and to transmit the second driving signal of the second drive node to the second bias output node; and controlling the first reverse bias unit by the first bias control terminal, to conduct the first drive node and the first bias output node; and executing operations as follows within a second time period of the (N+1)th frame:

controlling the first light-emitting unit of the first sub-pixel circuit to emit light by the first driving signal;

controlling the second light-emitting unit of the second sub-pixel circuit to emit light by the second driving signal;

controlling the first reverse bias unit by the first bias control terminal, to disconnect the first drive node from the first bias output node; and controlling the first reverse bias unit by the second bias control terminal, to disconnect the second drive node from the second bias output node;

wherein N is an integer greater than or equal to 1.

For example, the first sub-pixel circuit further includes a first data input unit and a first storage capacitor;

the driving method further comprises executing operations as follows within the first time period of the Nth frame:

controlling the first data input unit by a signal of the scanning terminal, to conduct the first data terminal and the first sub-pixel node, and to transmit the first data signal of the first data terminal to the first sub-pixel node; and storing a voltage level between the first sub-pixel node and the first voltage terminal by the first storage capacitor;

the driving method further comprises executing operations as follows within the second time period of the Nth frame:

controlling the first data input unit by the signal of the scanning terminal, to conduct the first data terminal and the first sub-pixel node, and to transmit the first data signal of the first data terminal to the first sub-pixel node; and storing the voltage level between the first sub-pixel node and the first voltage terminal by the first storage capacitor;

the driving method further comprises executing operations as follows within the first time period of the (N+1)th frame:

controlling the first data input unit by the signal of the scanning terminal, to conduct the first data terminal and the first sub-pixel node, and to transmit the first data signal of the first data terminal to the first sub-pixel node; and storing the voltage level between the first sub-pixel node and the first voltage terminal by the first storage capacitor; and the driving method further comprises executing operations as follows within the second time period of the (N+1)th frame:

controlling the first data input unit by the signal of the scanning terminal, to conduct the first data terminal and the first sub-pixel node, and to transmit the first data signal of the first data terminal to the first sub-pixel node; and storing the voltage level between the first sub-pixel node and the first voltage terminal by the first storage capacitor.

For example, the pixel circuit further comprises a light-emitting control unit; the light-emitting control unit is connected with a first voltage terminal, a first light-emitting control terminal, and a first light-emitting control node;

the driving method further comprises executing operations as follows within the first time period of the Nth frame:

controlling the light-emitting control unit by a signal of the first light-emitting control terminal, to conduct the first voltage terminal and the first light-emitting control node, and to output a voltage level of the first voltage terminal to the first light-emitting control node;

the driving method further comprises executing operations as follows within the second time period of the Nth frame:

controlling the light-emitting control unit by the signal of the first light-emitting control terminal, to conduct the first voltage terminal and the first light-emitting control node, and to output the voltage level of the first voltage terminal to the first light-emitting control node;

the driving method further comprises executing operations as follows within the first time period of the (N+1)th frame:

controlling the light-emitting control unit by the signal of the first light-emitting control terminal, to disconnect the first voltage terminal from the first light-emitting control node; and the driving method further comprises executing operations as follows within the second time period of the (N+1)th frame:

controlling the light-emitting control unit by the signal of the first light-emitting control terminal, to conduct the first voltage terminal and the first light-emitting control node, and to output the voltage level of the first voltage terminal to the first light-emitting control node.

For example, the second sub-pixel circuit further includes a second data input unit and a second storage capacitor;

the driving method further comprises executing operations as follows within the first time period of the Nth frame:

controlling the second data input unit by the signal of the scanning terminal, to conduct the second data terminal and the second sub-pixel node, and to transmit a second data signal of the second data terminal to the second sub-pixel node; and storing a voltage level between the second sub-pixel node and the first voltage terminal by the second storage capacitor;

the driving method further comprises executing operations as follows within the second time period of the Nth frame:

controlling the second data input unit by the signal of the scanning terminal, to conduct the second data terminal and the second sub-pixel node, and to transmit the second data signal of the second data terminal to the second sub-pixel node; and storing the voltage level between the second sub-pixel node and the first voltage terminal by the second storage capacitor;

the driving method further comprises executing operations as follows within the first time period of the (N+1)th frame:

controlling the second data input unit by the signal of the scanning terminal, to conduct the second data terminal and the second sub-pixel node, and to transmit the second data signal of the second data terminal to the second sub-pixel node; and storing the voltage level between the second sub-pixel node and the first voltage terminal by the second storage capacitor; and the driving method further comprises executing operations as follows within the second time period of the (N+1)th frame:

controlling the second data input unit by the signal of the scanning terminal, to conduct the second data terminal and the second sub-pixel node, and to transmit the second data signal of the second data terminal to the second sub-pixel node; and storing the voltage level between the second sub-pixel node and the first voltage terminal by the second storage capacitor.

For example, the pixel circuit further comprises a light-emitting control unit; and the light-emitting control unit is connected with a first voltage terminal, a second light-emitting control terminal, and a second light-emitting control node;

the driving method further comprises executing operations as follows within the first time period of the Nth frame:

controlling the light-emitting control unit by a signal of the second light-emitting control terminal, to disconnect the first voltage terminal from the second light-emitting control node;

the driving method further comprises executing operations as follows within the second time period of the Nth frame:

controlling the light-emitting control unit by the signal of the second light-emitting control terminal, to conduct the first voltage terminal and the second light-emitting control node and to transmit a voltage level of the first voltage terminal to the second light-emitting control node;

the driving method further comprises executing operations as follows within the first time period of the (N+1)th frame:

controlling the light-emitting control unit by the signal of the second light-emitting control terminal, to conduct the first voltage terminal and the second light-emitting control node and to transmit the voltage level of the first voltage terminal to the second light-emitting control node; and the driving method further comprises executing operations as follows within the second time period of the (N+1)th frame:

controlling; the light-emitting control unit by the signal of the second light-emitting control terminal, to conduct the first voltage terminal and the second light-emitting control node and to transmit the voltage level of the first voltage terminal to the second light-emitting control node.

For example, the pixel circuit further comprises a second reverse bias unit; and the second reverse bias unit is connected with a second bias output node, a first bias output node, a first light-emitting control terminal, a second light-emitting control terminal, and a second voltage terminal;

the driving method further comprises executing operations as follows within the first time period of the Nth frame:

controlling the second reverse bias unit by a signal of the first light-emitting control terminal, to conduct the second voltage terminal and the second bias output node, and to output a voltage level of the second voltage terminal to the second bias output node;

controlling the second reverse bias unit by a signal of the second light-emitting control terminal, to disconnect the second voltage terminal from the first bias output node;

the driving method further comprises executing operations as follows within the second time period of the Nth frame:

controlling the second reverse bias unit by the signal of the first light-emitting control terminal, to conduct the second voltage terminal and the second bias output node, and to output the voltage level of the second voltage terminal to the second bias output node; and controlling the second reverse bias unit by the signal of the second light-emitting control terminal, to conduct the second voltage terminal and the first bias output node, and to output the voltage level of the second voltage terminal to the first bias output node;

the driving method further comprises executing operations as follows within the first time period of the (N+1)th frame:

controlling the second reverse bias unit by the signal of the first light-emitting control terminal, to disconnect the second voltage terminal from the second bias output node;

controlling the second reverse bias unit by the signal of the second light-emitting control terminal, to conduct the second voltage terminal and the first bias output node, and to output the voltage level of the second voltage terminal to the first bias output node; and the driving method further comprises executing operations as follows within the second time period of the (N+1)th frame:

controlling the second reverse bias unit by the signal of the first light-emitting control terminal, to conduct the second voltage terminal and the second bias output node, and to output the voltage level of the second voltage terminal to the second bias output node; and controlling the second reverse bias unit by the signal of the second light-emitting control terminal, to conduct the second voltage terminal and the first bias output node, and to output the voltage level of the second voltage terminal to the first bias output node.

In a third aspect, embodiments of the disclosure provide a driving method of a pixel circuit, comprising:

executing operations as follows within a first time period of an Nth frame:

controlling a first light-emitting unit of a first sub-pixel circuit to emit light by a first driving signal;

controlling a first reverse bias unit by a first bias control terminal, to conduct a first drive node and a first bias output node, and to transmit the first driving signal of the first drive node to the first bias output node; and controlling the first reverse bias unit by a second bias control terminal, to conduct a second drive node and a second bias output node; and executing operations as follows within a second time period of the Nth frame:

controlling a second light-emitting unit of a second sub-pixel circuit to emit light by a second driving signal;

controlling the first reverse bias unit by the second bias control terminal, to conduct the second drive node and the second bias output node, and to transmit the second driving signal of the second drive node to the second bias output node; and controlling the first reverse bias unit by the first bias control terminal, to conduct the first drive node and the first bias output node.

For example, the first sub-pixel circuit further includes a first data input unit and a first storage capacitor;

the driving method further comprises executing operations as follows within the first time period of the Nth frame:

controlling the first data input unit by a signal of the scanning terminal, to conduct the first data terminal and a first sub-pixel node, and to transmit a first data signal of the first data terminal to the first sub-pixel node; and storing a voltage level between the first sub-pixel node and the first voltage terminal by the first storage capacitor; and the driving method further comprises executing operations as follows within the second time period of the Nth frame:

controlling the first data input unit by the signal of the scanning terminal, to conduct the first data terminal and the first sub-pixel node, and to transmit the first data signal of the first data terminal to the first sub-pixel node; and storing the voltage level between the first sub-pixel node and the first voltage terminal by the first storage capacitor.

For example, the pixel circuit further comprises a light-emitting control unit; and the light-emitting control unit is connected with a first voltage terminal, a first light-emitting control terminal, and a first light-emitting control node;

the driving method further comprises executing operations as follows within the first time period of the Nth frame:

controlling the light-emitting control unit by a signal of the first light-emitting control terminal, to conduct the first voltage terminal and the first light-emitting control node, and to output a voltage level of the first voltage terminal to the first light-emitting control node; and the driving method further comprises executing operations as follows within the second time period of the Nth frame:

controlling the light-emitting control unit by the signal of the first light-emitting control terminal, to disconnect the first voltage terminal from the first light-emitting control node.

For example, the second sub-pixel circuit further includes a second data input unit and a second storage capacitor;

the driving method further comprises executing operations as follows within the first time period of the Nth frame:

controlling the second data input unit by the signal of the scanning terminal, to conduct the second data terminal and the second sub-pixel node, and to transmit a second data signal of the second data terminal to the second sub-pixel node; and storing a voltage level between the second sub-pixel node and the first voltage terminal by the second storage capacitor; and the driving method further comprises executing operations as follows within the second time period of the Nth frame:

controlling the second data input unit by the signal of the scanning terminal, to conduct the second data terminal and the second sub-pixel node, and to transmit the second data signal of the second data terminal to the second sub-pixel node; and storing the voltage level between the second sub-pixel node and the first voltage terminal by the second storage capacitor.

For example, the pixel circuit further comprises a light-emitting control unit; the light-emitting control unit is connected with a first voltage terminal, a second light-emitting control terminal, and a second light-emitting control node;

the driving method further comprises executing operations as follows within the first time period of the Nth frame:

controlling the light-emitting control unit by a signal of the second light-emitting control terminal, to disconnect the first voltage terminal from the second light-emitting control node; and the driving method further comprises executing operations as follows within the second time period of the Nth frame:

controlling the light-emitting control unit by the signal of the second light-emitting control terminal, to conduct the first voltage terminal and the second light-emitting control node and to transmit a voltage level of the first voltage terminal to the second light-emitting control node.

In a fourth aspect, embodiments of the disclosure provide a display device, comprising the pixel circuit described above.

A pixel circuit provided by embodiments of the present disclosure comprises first reverse bias unit, as well as a first sub-pixel circuit and a second sub-pixel circuit adjacent to each other, where the first sub-pixel circuit includes a first light-emitting unit, and the second sub-pixel circuit includes a second light-emitting unit. In one frame of image, the first light-emitting unit in the first sub-pixel circuit is driven to emit light by control of a first driving signal, and the first driving signal is used, by the first reverse bias unit, as a reverse bias voltage of the second light-emitting unit in the second sub-pixel circuit; or, the second light-emitting unit in the second sub-pixel circuit is driven to emit light by control of a second driving signal, and the second driving signal is used, by the first reverse bias unit, as a reverse bias voltage of the first light-emitting unit in the first sub-pixel circuit. Thus, reverse biasing performed by the first driving signal of the first sub-pixel circuit on the second light-emitting unit in the second sub-pixel circuit or reverse biasing performed by the second driving signal of the second sub-pixel circuit on the first light-emitting unit of the first sub-pixel circuit is implemented, so that the first light-emitting unit or the second light-emitting unit does not have to be in a direct current bias condition for a long time. This slows down aging of the first light-emitting unit and the second light-emitting unit, and increases service time of the first light-emitting unit and the second light-emitting unit. The pixel circuit provided by embodiments of the present disclosure does not have any other reverse bias voltage connected therewith externally. By using the first driving signal of the first sub-pixel circuit or the second driving signal of the second sub-pixel circuit as the reverse bias voltage of the second light-emitting unit in the second sub-pixel circuit or the first light-emitting unit in the first sub-pixel circuit, it slows down a circuit aging effect of the first light-emitting unit and the second light-emitting unit without affecting an AMOLED display effect, and at a same time, it reduces a wiring difficulty of the pixel circuit and influence of cross-talk of a bias voltage line on other signal lines.

BRIEF DESCRIPTION OF THE DRAWINGS

In order to illustrate the technical solutions in the embodiments of the present disclosure or the existing arts more clearly, the drawings needed to be used in the description of the embodiments or the existing arts will be briefly described in the following; it is obvious that the drawings described below are only related to some embodiments of the present disclosure, for one ordinary skilled person in the art, other drawings can be obtained according to these drawings without making other inventive work.

REFERENCE SIGNS

Figure 1:
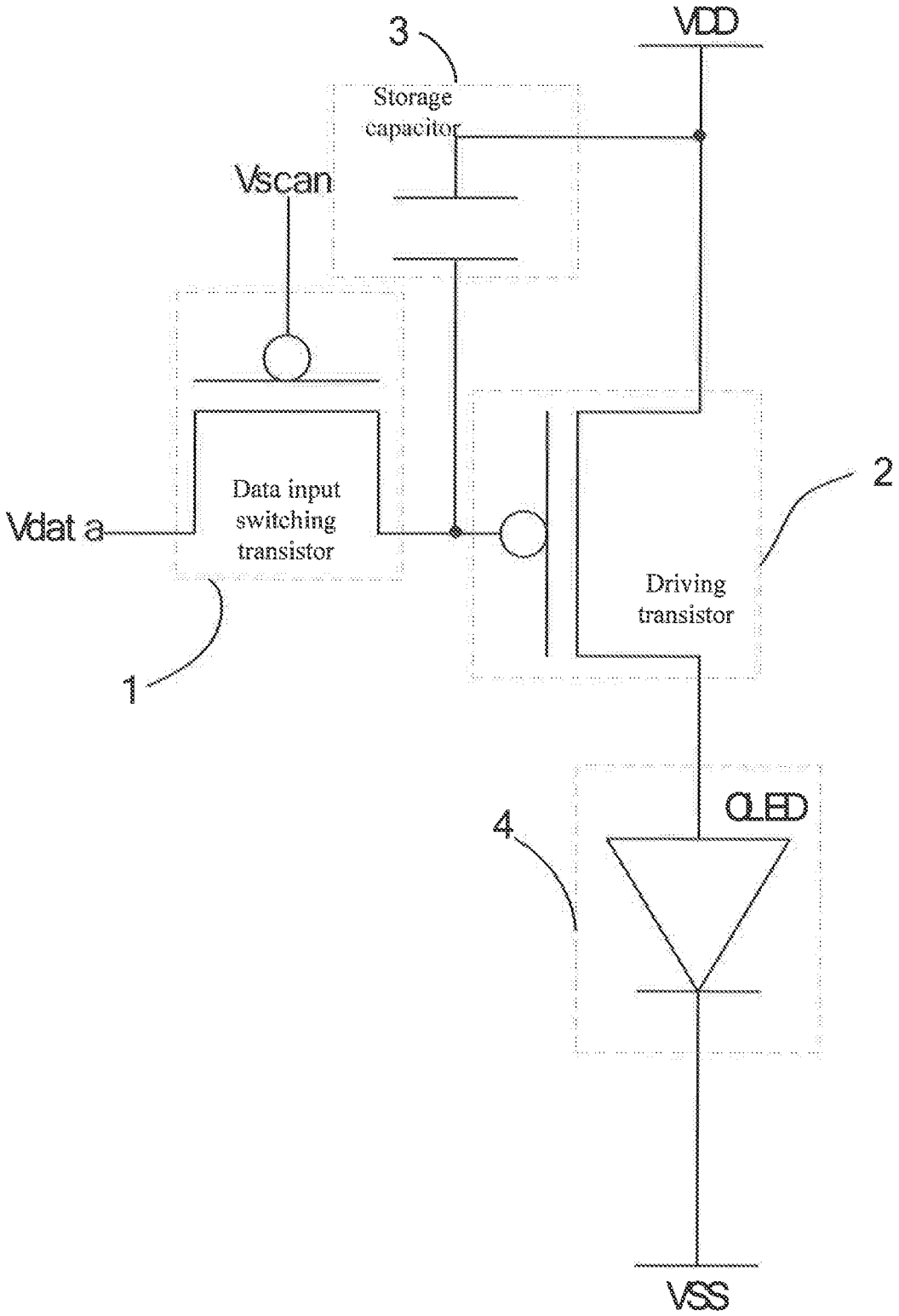
FIG. 1 (Prior Art)
FIG. 1 is a structural schematic diagram of a 2T1C pixel driving circuit of an AMOLED in existing technologies.

Pixel circuit-10;

First sub-pixel circuit—20; first light-emitting unit—201 first data input unit—202; first storage capacitor—CS1; first organic light-emitting diode—OLED1; scanning terminal—Vscan; first data terminal—Vdata1;

Second sub-pixel circuit—30; second light-emitting unit—301; second data input unit—302; second storage capacitor—CS2; second organic light-emitting diode—OLED2; second data terminal—Vdata2;

Light-emitting control unit—40;

First reverse bias unit—50;

Second reverse bias unit—60;

First sub-pixel node—a; second sub-pixel node—b; first light-emitting control node—c; second light-emitting control node—d; first drive node—e; second drive node—f; second bias output node—g; first bias output node—h;

First light-emitting control terminal—Ctrl-1; second light-emitting control terminal—Ctrl-2; first bias control terminal—Ctrl-3; second bias control terminal—Ctrl-4;

First voltage terminal—VDD; second voltage terminal—VSS;

First light-emitting control transistor—T1; second light-emitting control transistor—T2; first data input transistor—T3; second data input transistor—14; first driving transistor—T5; second driving transistor—16; first reverse bias transistor—17 second reverse bias transistor T8; third reverse bias transistor—19; and fourth reverse bias transistor—T10.

DETAILED DESCRIPTION

All transistors used in all embodiments of the present disclosure may be thin-film transistors or field-effect transistors or other devices having identical characteristics, and the transistors used in the embodiments of the present disclosure are mainly switching transistors according to their functions in a circuit. Since a source electrode and a drain electrode of a switching transistor used herein are symmetrical, the source electrode and the drain electrode are interchangeable. In the embodiments of the present disclosure, in order to distinguish the two electrodes of the transistor except a gate electrode, the source electrode therein is referred to as a first terminal, and the drain electrode is referred to as a second terminal. Of course, the first terminal may be the drain electrode and the second terminal may be the source electrode. According to configuration in the drawings, it is stipulated that a middle terminal of the transistor is the gate electrode, a signal input terminal is the source electrode, and a signal output terminal is the drain electrode. In addition, the switching transistors used in the embodiments of the present disclosure include P-type switching transistors and/or N-type switching transistors, where a P-type switching transistor is turned on when its gate electrode is at a low voltage level and is turned off when its gate electrode is at a high voltage level, and an N-type switching transistor is turned on when its gate electrode is at the high voltage level and is turned off when its gate electrode is at the low voltage level. The drive transistors include P-type transistors and/or N-type transistors. A P-type drive transistor is in an amplified state or a saturated state, when a voltage of its gate electrode is at the low voltage level (the gate electrode voltage is less than a source electrode voltage) and an absolute value of a voltage difference between the gate electrode and the source electrode is greater than a threshold voltage. An N-type drive transistor is in the amplified state or the saturated state, when the gate electrode voltage is at the high voltage level (the gate electrode voltage is greater than the source electrode voltage) and the absolute value of the voltage difference between the gate electrode and the source electrode is greater than the threshold voltage.

It should be noted that, the present application uses words such as "first" and "second" merely to distinguish identical items or similar items having basically identical functions and effects, but the words such as "first" and "second" do not limit the present disclosure in terms of quantity and execution order. For example, "a first transistor", "a second transistor" and "a fourth transistor" may appear in a same embodiment without "a third transistor", then the words "first", "second", and "fourth" may only be understood as to distinguish between different transistors, but should not be understood that this embodiment further includes "a third transistor". Reverse biasing refers to applying a certain voltage to a certain point in a circuit, so that a potential of the point shifts from a zero potential to a positive potential or a negative potential which is reverse to what is predetermined.

A pixel circuit provided by embodiments of the present disclosure comprises a first reverse bias unit, as well as a first sub-pixel circuit and a second sub-pixel circuit adjacent to each other, where the first sub-pixel circuit includes a first light-emitting unit, and the second sub-pixel circuit includes a second light-emitting unit. In one frame of image, the first light-emitting unit in the first sub-pixel circuit is driven to emit light by control of a first driving signal, and the first driving signal is used, by the first reverse bias unit, as a reverse bias voltage of the second light-emitting unit in the second sub-pixel circuit; or, the second light-emitting unit in the second sub-pixel circuit is driven to emit light by control of a second driving signal, and the second driving signal is used, by the first reverse bias unit, as a reverse bias voltage of the first light-emitting unit in the first sub-pixel circuit. Thus, reverse biasing performed by the first driving signal of the first sub-pixel circuit on the second light-emitting unit in the second sub-pixel circuit is implemented, or reverse biasing performed by the second driving signal of the second sub-pixel circuit on the first light-emitting unit of the first sub-pixel circuit is implemented, so that the first light-emitting unit or the second light-emitting unit does not have to be in a direct current bias condition for a long time. This slows down aging of the first light-emitting unit and the second light-emitting unit, and increases service time of the first light-emitting unit and the second light-emitting unit. The pixel circuit provided by embodiments of the present disclosure does not have any other reverse bias voltage connected therewith externally. By using the first driving signal of the first sub-pixel circuit as the reverse bias voltage of the second light-emitting unit in the second sub-pixel circuit, or by using the second driving signal of the second sub-pixel circuit as the reverse bias voltage of the first light-emitting unit in the first sub-pixel circuit, it slows down a circuit aging effect of the first light-emitting unit and the second light-emitting unit without affecting an AMOLED display effect, and at a same time, it reduces a wiring difficulty of the pixel circuit and influence of crosstalk of a bias voltage line on other signal lines.

Hereafter, the technical solutions of the embodiments of the present disclosure will be described in a clearly and fully understandable way in connection with the drawings related to the embodiments of the disclosure. It is obvious that the described embodiments are just a part but not all of the embodiments of the present disclosure. Based on embodiments of the present disclosure, all other embodiments obtained by those skilled in the art without making other inventive work should be within the scope of the present disclosure.

Embodiment One

Figure 2:
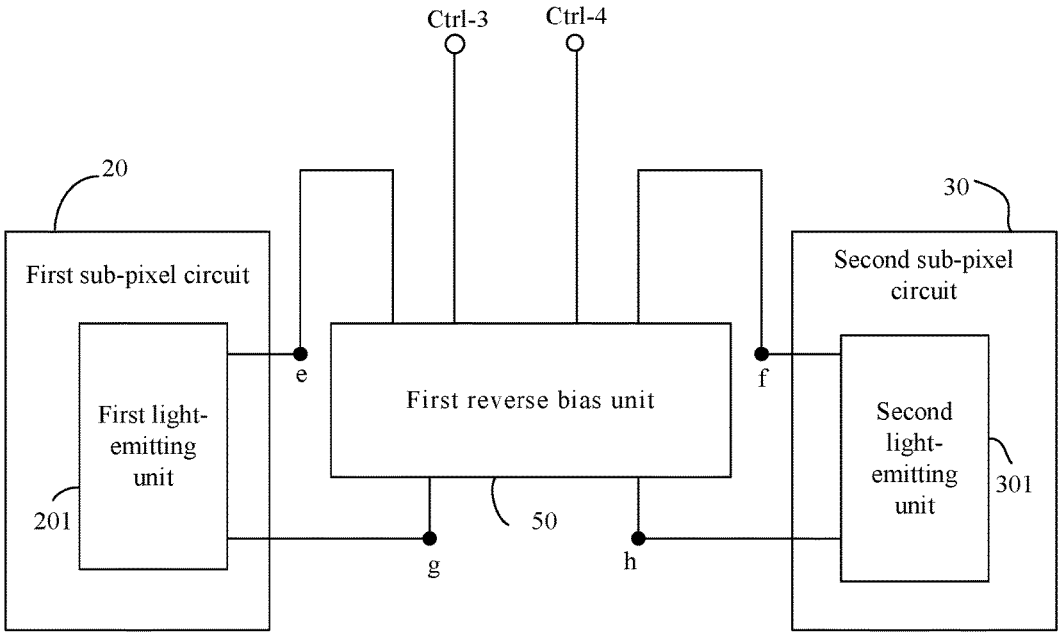
FIG. 2 is a structural schematic diagram of a pixel circuit provided by an embodiment of the present disclosure.

With reference to FIG. 2, an embodiment of the present disclosure provides a pixel circuit 10, comprising: a first reverse bias unit 50, and a first sub-pixel circuit 20 and a second sub-pixel circuit 30 that are adjacent to each other. The first sub-pixel circuit 20 includes a first light-emitting unit 201, and the second sub-pixel circuit 30 includes a second light-emitting unit 301. The first light-emitting unit 201 is connected with a first drive node e and a second bias output node g, and the second light-emitting unit 301 is connected with a second drive node f and a first bias output node h; the first reverse bias unit 50 is connected with the first drive node e, the second drive node f, the second bias output node g, the first bias output node h, a first bias control terminal Ctrl-3 and a second bias control terminal Ctrl-4.

The first light-emitting unit 201 is configured to emit light under control of a first driving signal, and output the first driving signal to the first drive node e; the first reverse bias unit 50 is configured to output the first driving signal of the first drive node e to the first bias output node h under control of the first bias control terminal Ctrl-3; and the first bias output node h supplies a reverse bias voltage to the second light-emitting unit 301;

Alternatively, the second light-emitting unit 301 is configured to emit light under control of a second driving signal, and output the second driving signal to the second bias output node g; the first reverse bias unit 50 is further configured to output the second driving signal of the second drive node f to the second bias output node g under control of the second bias control terminal Ctrl-4; and the second bias output node g supplies a reverse bias voltage to the first light-emitting unit 201.

In the above-described solution, the pixel circuit comprises a first reverse bias unit, as well as a first sub-pixel circuit and a second sub-pixel circuit adjacent to each other, where the first sub-pixel circuit includes a first light-emitting unit, and the second sub-pixel circuit includes a second light-emitting unit. In one frame of image, the first light-emitting unit in the first sub-pixel circuit is driven to emit light by control of a first driving signal, and the first driving signal is used, by the first reverse bias unit, as a reverse bias voltage of the second light-emitting unit in the second sub-pixel circuit; or, the second light-emitting unit in the second sub-pixel circuit is driven to emit light by control of a second driving signal, and the second driving signal is used, by the first reverse bias unit, as a reverse bias voltage of the first light-emitting unit in the first sub-pixel circuit. Thus, reverse biasing performed by the first driving signal of the first sub-pixel circuit on the second light-emitting unit in the second sub-pixel circuit is implemented, or reverse biasing performed by the second driving signal of the second sub-pixel circuit on the first light-emitting unit of the first sub-pixel circuit is implemented, so that the first light-emitting unit or the second light-emitting unit does not have to be in a direct current bias condition for a long time. This slows down aging of the first light-emitting unit and the second light-emitting unit, and increases service time of the first light-emitting unit and the second light-emitting unit. The pixel circuit provided by embodiments of the present disclosure does not have any other reverse bias voltage connected therewith externally. By using the first driving signal of the first sub-pixel circuit as the reverse bias voltage of the second light-emitting unit in the second sub-pixel circuit, or by using the second driving signal of the second sub-pixel circuit as the reverse bias voltage of the first light-emitting unit in the first sub-pixel circuit, it slows down a circuit aging effect of the first light-emitting unit and the second light-emitting unit without affecting an AMOLED display effect, and at a same time, it reduces a wiring difficulty of the pixel circuit and influence of crosstalk of a bias voltage line on other signal lines.

Embodiment Two

Figure 3:
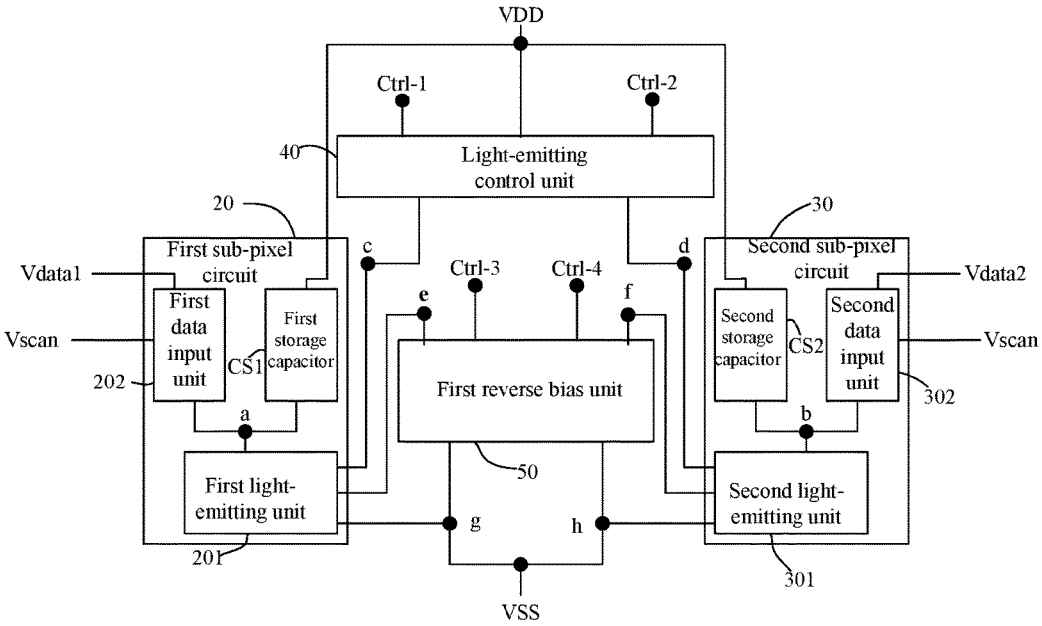
FIG. 3 is a specific structural schematic diagram of a pixel circuit provided by an embodiment of the present disclosure.
Figure 5:
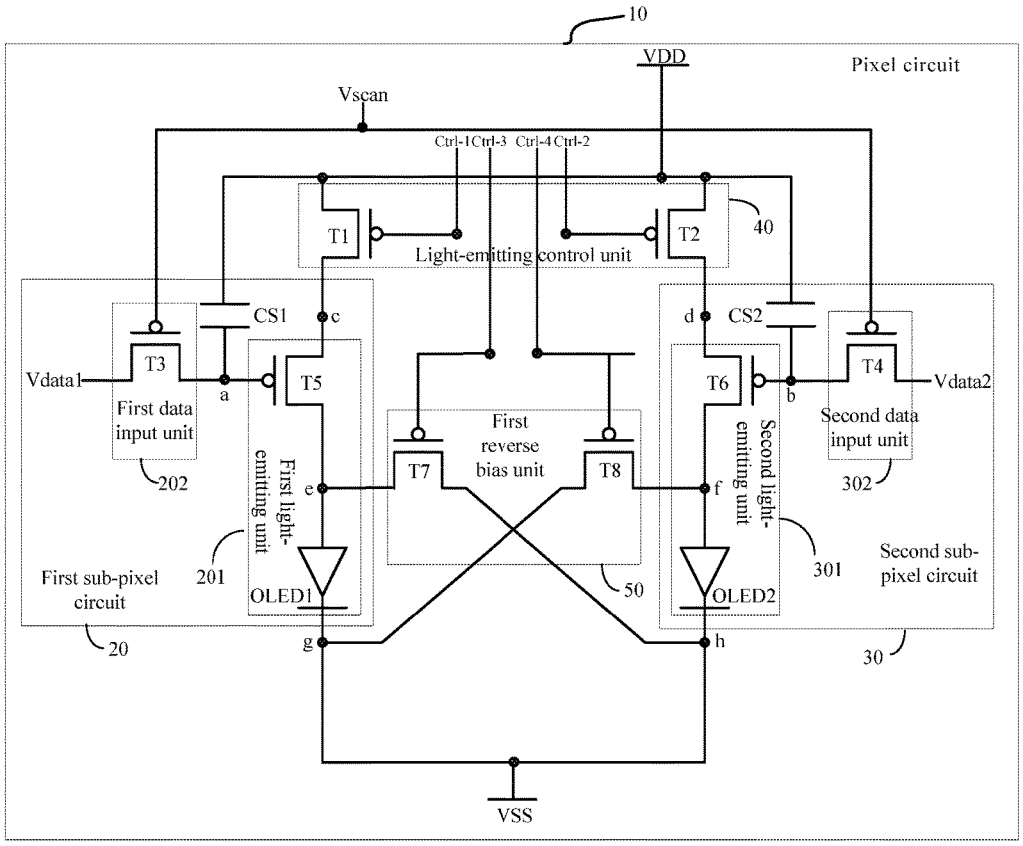
FIG. 5 is a structural schematic diagram of an example implementation of a pixel circuit provided by an embodiment of the present disclosure.

With reference to FIG. 3, FIG. 4, FIG. 5 and FIG. 6, embodiments of the present disclosure provide a pixel circuit 10, whose specific implementation is as follows:

Scenario One: as shown in FIG. 3 and FIG. 5, an embodiment of the present disclosure provides a pixel circuit 10. A first sub-pixel circuit 20 in the pixel circuit 10 further includes: a first data input unit 202, and a first storage capacitor CS1;

The first data input unit 202 is connected with a first data terminal Vdata1, a scanning terminal Vscan and a first sub-pixel node a; the first data input unit 202 is configured to output a first data signal of the first data terminal Vdata to the first sub-pixel node a under control of a signal of the scanning terminal Vscan;

The first storage capacitor CS1 is connected with the first sub-pixel node a and a first voltage terminal VDD, and the first storage capacitor CS1 is used for storing a voltage level between the first sub-pixel node a and the first voltage terminal VDD;

The first light-emitting unit 201 is further connected with the first sub-pixel node a and a first light-emitting control node c; and the first light-emitting unit 201 is configured to output a first driving signal to a first drive node e, under control of a signal of the first sub-pixel node a, a signal of the first light-emitting control node c, and a signal of the second bias output node g.

The pixel circuit 10 further comprises: a light-emitting control unit 40; the light-emitting control unit 40 is connected with the first voltage terminal VDD, a first light-emitting control terminal Ctrl-1, and the first light-emitting control node c; the light-emitting control unit 40 is configured to output a voltage level of the first voltage terminal VDD to the first light-emitting control node c under control of the first light-emitting control terminal Ctrl-1.

A second sub-pixel circuit 30 in the pixel circuit 10 further includes: a second data input unit 302, and a second storage capacitor CS2;

The second data input unit 302 is connected with a second data terminal Vdata2, the scanning terminal Vscan and a second sub-pixel node b; the second data input unit 302 is configured to output a second data signal of the second data terminal Vdata2 to the second sub-pixel node b under control of the signal of the scanning terminal Vscan;

The second storage capacitor CS2 is connected with the second sub-pixel node h and the first voltage terminal VDD, and the second storage capacitor CS2 is used for storing a voltage level between the second sub-pixel node b and the first voltage terminal VDD;

The second light-emitting unit 301 is further configured to output a second driving signal to a second drive node f under control of a signal of the second sub-pixel node b, a signal of a second light-emitting control node d and a signal of a first bias output node h.

The pixel circuit 10 further comprises: a light-emitting control unit 40. The light-emitting control unit 40 is connected with the first voltage terminal VDD, a second light-emitting control terminal Ctrl-2, and the second light-emitting control node d; and the light-emitting control unit 40 is configured to output the voltage level of the first voltage terminal VDD to the second light-emitting control node d under control of the second light-emitting control terminal Ctrl-2.

The second bias output node g and the first bias output node h in the pixel circuit 10 are connected with a second voltage terminal VSS;

For example, as shown in FIG. 3 and FIG. 5, the first data input unit 202 includes a first data input transistor T3; a gate electrode of the first data input transistor T3 is connected with the scanning terminal Vscan, a first terminal of the first data input transistor T3 is connected with the first data terminal Vdata1 and a second terminal of the first data input transistor T3 is connected with the first sub-pixel node a.

The light-emitting control unit 40 in the pixel circuit 10 includes: a first light-emitting control transistor T1; a gate electrode of the first light-emitting control transistor T1 is connected with the first light-emitting control terminal Ctrl-1, a first terminal of the first light-emitting control transistor T1 is connected with the first voltage terminal VDD, and a second terminal of the first light-emitting control transistor T1 is connected with the first light-emitting control node c.

The second data input unit 302 in the pixel circuit 10 includes a second data input transistor T4; a gate electrode of the second data input transistor T4 is connected with the scanning terminal Vscan, a first terminal of the second data input transistor T4 is connected with the second data terminal Vdata2, and a second terminal of the second data input transistor T4 is connected with the second sub-pixel node b.

The light-emitting control unit 40 in the pixel circuit 10 includes: a second light-emitting control transistor T2; a gate electrode of the second light-emitting control transistor T2 is connected with the second light-emitting control terminal Ctrl-2, a first terminal of the second light-emitting control transistor T2 is connected with the first voltage terminal VDD, and a second terminal of the second light-emitting control transistor T2 is connected with the second light-emitting control node d.

The first reverse bias unit 50 in the pixel circuit 10 includes a first reverse bias transistor T7 and a second reverse bias transistor T8; a gate electrode of the first reverse bias transistor T7 is connected with a first bias control terminal Ctrl-3, a first terminal of the first reverse bias transistor T7 is connected with the first drive node e, and a second terminal of the first reverse bias transistor T7 is connected with the first bias output node h;

A gate electrode of the second reverse bias transistor T8 is connected with a second bias control terminal Ctrl-4, a first terminal of the second reverse bias transistor T8 is connected with the second drive node f, and a second terminal of the second reverse bias transistor T8 is connected with the second bias output node g;

The first bias control terminal Ctrl-3 and the second bias control terminal Ctrl-4 are connected with a same signal control line or similar signal control lines.

The first light-emitting unit 201 in the pixel circuit 10 includes a first driving transistor T5 and a first organic light-emitting diode OLED1. A gate electrode of the first driving transistor T5 is connected with the first sub-pixel node a, a first terminal of the first driving transistor T5 is connected with the first light-emitting control node c, a second terminal of the first driving transistor T5 is connected with the first drive node e and an anode of the organic light-emitting diode OLED1, and a cathode of the first organic light-emitting diode OLED1 is connected with the second bias output node g.

The second light-emitting unit 301 in the pixel circuit 10 includes a second driving transistor T6 and a second organic light-emitting diode OLED2. A gate electrode of the second driving transistor T6 is connected with the second sub-pixel node b, a first terminal of the second driving transistor T6 is connected with the second light-emitting control node d, a second terminal of the second driving transistor T6 is connected with the second drive node f and an anode of the organic light-emitting diode OLED2, and a cathode of the second organic light-emitting diode OLED2 is connected with the first bias output node h.

It should be noted that, the first light-emitting control terminal Ctrl-1 inputs a first control signal; the second light-emitting control terminal Ctrl-2 inputs a second control signal; where a phase difference between the first control signal and the second control signal is 0 degree or 80 degrees;

The first bias control terminal Ctrl-3 inputs a third control signal; and the second bias control terminal Ctrl-4 inputs a fourth control signal; where a phase difference between the third control signal and the fourth control signal is 0 degree.

In the above-described solution, the pixel circuit comprises the first sub-pixel circuit and the second sub-pixel circuit adjacent to each other, where the first sub-pixel circuit includes the first organic light-emitting diode OLED1 and the first data input unit, and the second sub-pixel circuit includes the second organic light-emitting diode OLED2 and the second data input unit. The pixel circuit further comprises the light-emitting control unit, the first reverse bias unit and the second reverse bias unit. In one frame of image, the first data input unit and the second data input unit are controlled by the scanning terminal; and the light-emitting control unit, the first reverse bias unit and the second reverse bias unit are respectively controlled by timing signals of the first light-emitting control terminal, the second light-emitting control terminal, the first bias control terminal amid the second bias control terminal. Thus, reverse biasing performed by the first driving signal of the first sub-pixel circuit on the OLED2 of the second sub-pixel circuit is implemented, or reverse biasing performed by the second driving signal of the second sub-pixel circuit on the OLED1 of the first sub-pixel circuit is implemented. Therefor the OLED1 of the first sub-pixel circuit or the OLED2 of the second sub-pixel circuit does not have to be in a direct current bias condition for a long time, which slows down aging of the OLED1 of the first sub-pixel circuit or the OLED2 of the second sub-pixel circuit, and increases service time of the OLED1 of the first sub-pixel circuit and the OLED2 of the second sub-pixel circuit. The pixel circuit provided by embodiments of the present disclosure does not have any other reverse bias voltage connected therewith externally, but the first driving signal of the first sub-pixel circuit (and/or the second driving signal of the second sub-pixel circuit) is used as the reverse bias voltage of the OLED2 of the second sub-pixel circuit (and/or the reverse bias voltage of the OLED1 of the first sub-pixel circuit). It slows down a circuit aging effect of the OLED1 of the first sub-pixel circuit and the OLED2 of the second sub-pixel circuit without affecting an AMOLED display effect, and at a same time, reduces a wiring difficulty of the pixel circuit and influence of crosstalk of a bias voltage line on other signal lines.

Figure 4:
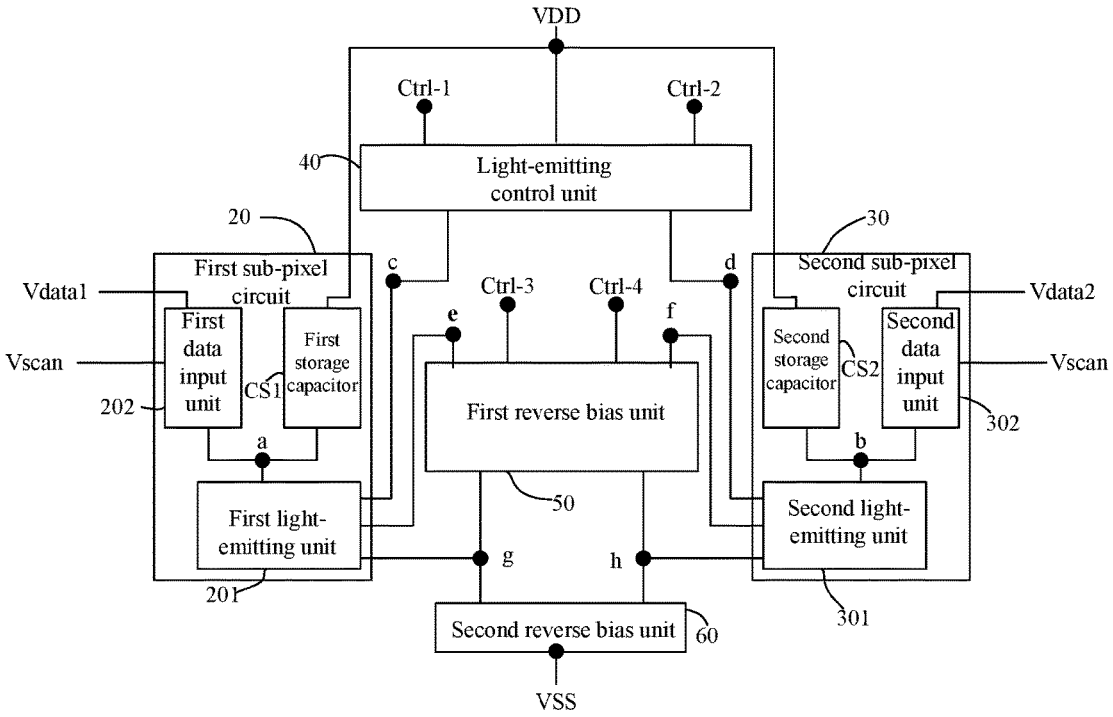
FIG. 4 is another specific structural schematic diagram of a pixel circuit provided by an embodiment of the present disclosure.
Figure 6:
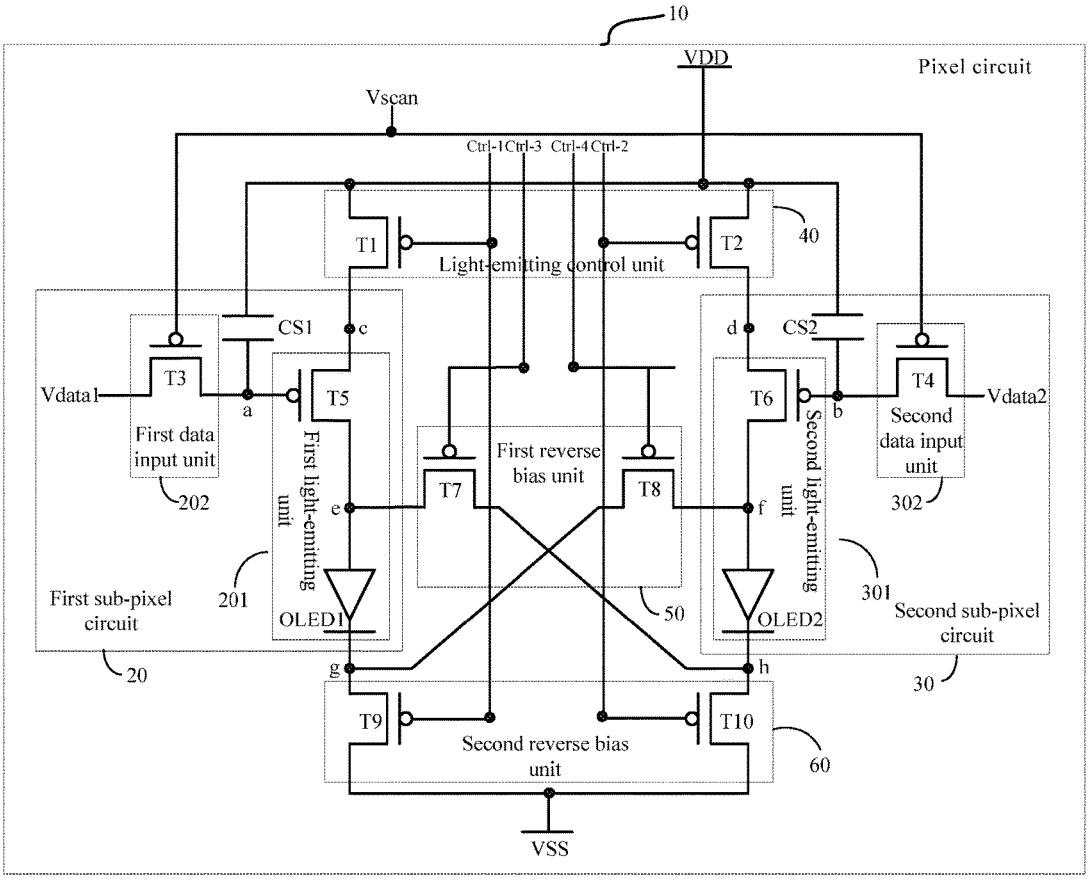
FIG. 6 is a structural schematic diagram of another example implementation of a pixel circuit provided by an embodiment of the present disclosure.

Scenario Two: as shown in FIG. 4 and FIG. 6, an embodiment of the present disclosure provides a pixel circuit 10. A first sub-pixel circuit 20 in the pixel circuit 10 further includes: a first data input unit 202, and a first storage capacitor CSI The first data input unit 202 is connected with a first data terminal Vdata1, a scanning terminal Vscan and a first sub-pixel node a; the first data input unit 202 is configured to output a first data signal of the first data terminal Vdata to the first sub-pixel node a under control of a signal of the scanning terminal Vscan;

The first storage capacitor CS1 is connected with the first sub-pixel node a and a first voltage terminal VDD, and the first storage capacitor CS1 is used for storing a voltage level between the first sub-pixel node a and the first voltage terminal VDD;

The first light-emitting unit 201 is further connected with the first sub-pixel node a, the first light-emitting control node c and the second bias output node g; the first light-emitting unit 201 is configured to output the first driving signal to the first drive node e, under the control of a signal of the first sub-pixel node a, a signal of the first light-emitting control node c, and a signal of the second bias output node g.

The pixel circuit 10 further comprises: a light-emitting control unit 40. The light-emitting control unit 40 is connected with the first voltage terminal VDD, the first light-emitting control terminal Ctrl-1, and the first light-emitting control node c; and the light-emitting control unit 40 is configured to output the voltage level of the first voltage terminal VDD to the first light-emitting control node c under the control of the first light-emitting control terminal Ctrl-1.

The second sub-pixel circuit 30 in the pixel circuit 10 further includes the second data input unit 302 and the second storage capacitor CS2;

The second data input unit 302 is connected with the second data terminal Vdata2, the scanning terminal Vscan and the second sub-pixel node b; the second data input unit 302 is configured to output a second data signal of the second data terminal Vdata2 to the second sub-pixel node b under control of the signal of the scanning terminal Vscan;

The second storage capacitor CS2 is connected with the second sub-pixel node b and the first voltage terminal VDD, and the second storage capacitor CS2 is used for storing a voltage level between the second sub-pixel node b and the first voltage terminal VDD;

The second light-emitting unit 301 is further configured to output a second driving signal to a second drive node f under control of a signal of the second sub-pixel node b, a signal of a second light-emitting control node d and a signal of a first bias output node h.

The light-emitting control unit 40 is further connected with the second light-emitting control terminal Ctrl-2 and the second light-emitting control node d; the light-emitting control unit 40 is configured to output the voltage level of the first voltage terminal VDD to the second light-emitting control node d under the control of the second light-emitting control terminal Ctrl-2.

The pixel circuit 10 further comprises: a second reverse bias unit 60. The second reverse bias unit 30 is connected with the second bias output node g, the first bias output node h, the first light-emitting control terminal Ctrl-1, the second light-emitting control terminal Ctrl-2, and the second voltage terminal VSS; the second reverse bias unit 60 is configured to output a voltage level of the second voltage terminal VSS to the second bias output node g under the control of the first light-emitting control terminal Ctrl-1; and the second reverse bias unit 60 is further configured to output the voltage level of the second voltage terminal VSS to the first bias output node h under the control of the second light-emitting control terminal Ctrl-2.

As shown in FIG. 4 and FIG. 6, the first data input unit 202 includes the first data input transistor T3. The gate electrode of the first data input transistor T3 is connected with the scanning terminal Vscan, the first terminal of the first data input transistor T3 is connected with the first data terminal Vdata1 and the second terminal of the first data input transistor T3 is connected with the first sub-pixel node a.

The light-emitting control unit 40 in the pixel circuit 10 includes: the first light-emitting control transistor T1. The gate electrode of the first light-emitting control transistor T1 is connected with the first light-emitting control terminal Ctrl-1, the first terminal of the first light-emitting control transistor T1 is connected with the first voltage terminal VDD, and the second terminal of the first light-emitting control transistor T1 is connected with the first light-emitting control node c.

The second data input unit 302 in the pixel circuit 10 includes the second data input transistor T4. The gate electrode of the second data input transistor T4 is connected with the scanning terminal Vscan, the first terminal of the second data input transistor T4 is connected with the second data terminal Vdata2 and the second terminal of the second data input transistor T4 is connected with the second sub-pixel node b.

The light-emitting control unit 40 in the pixel circuit 10 further includes: the second light-emitting control transistor T2. The gate electrode of the second light-emitting control transistor T2 is connected with the second light-emitting control terminal Ctrl-2, the first terminal of the second light-emitting control transistor T2 is connected with the first voltage terminal VDD, and the second terminal of the second light-emitting control transistor T2 is connected with the second light-emitting control node d.

The first reverse bias unit 50 in the pixel circuit 10 includes the first reverse bias transistor T7 and the second reverse bias transistor T8. The gate electrode of the first reverse bias transistor T7 is connected with the first bias control terminal Ctrl-3, the first terminal of the first reverse bias transistor T7 is connected with the first drive node e, the second terminal of the first reverse bias transistor T7 is connected with the first bias output node h;

The gate electrode of the second reverse bias transistor T8 is connected with a second bias control terminal Ctrl-4, the first terminal of the second reverse bias transistor T8 is connected with the second drive node f, and the second terminal of the second reverse bias transistor T8 is connected with the second bias output node g;

The first bias control terminal Ctrl-3 and the second bias control terminal Ctrl-4 are connected with a same signal control line or similar signal control lines.

The second reverse bias unit 60 in the pixel circuit 10 includes a third reverse bias transistor T9 and a fourth reverse bias transistor T10. A gate electrode of the third reverse bias transistor T9 is connected with the first light-emitting control terminal Ctrl-1, a first terminal of the third reverse bias transistor T9 is connected with the second bias output node g, and a second terminal of the third reverse bias transistor T9 is connected with the second voltage terminal VSS;

A gate electrode of the fourth reverse bias transistor T10 is connected with the second light-emitting control terminal Ctrl-2, a first terminal of the fourth reverse bias transistor T10 is connected with the first bias output node h, and a second terminal of the fourth reverse bias transistor T10 is connected with the second voltage terminal VSS.

For example, the third reverse bias transistor T9 and the fourth reverse bias transistor T10 are transistors of a same type, and the first light-emitting control terminal Ctrl-1 and the second light-emitting control terminal Ctrl-2 are connected with different signal control lines;

Alternatively, the third reverse bias transistor T9 and the fourth reverse bias transistor T10 are transistors of different types, and the first light-emitting control terminal Ctrl-1 and the second light-emitting control terminal Ctrl-2 are connected with a same signal control line.

The first light-emitting unit 201 in the pixel circuit 10 includes a first driving transistor T5 and a first organic light-emitting diode OLED1. A gate electrode of the first driving transistor T5 is connected with the first sub-pixel node a, a first terminal of the first driving transistor T5 is connected with the first light-emitting control node c, a second terminal of the first driving transistor T5 is connected with the first drive node e and an anode of the organic light-emitting diode OLED1, and a cathode of the first organic light-emitting diode OLED1 is connected with the second bias output node g.

The second light-emitting unit 301 in the pixel circuit 10 includes a second driving transistor T6 and a second organic light-emitting diode OLED2. A gate electrode of the second driving transistor T6 is connected with the second sub-pixel node b, a first terminal of the second driving transistor T6 is connected with the second light-emitting control node d, a second terminal of the second driving transistor T6 is connected with the second drive node f and an anode of the organic light-emitting diode OLED2, and a cathode of the second organic light-emitting diode OLED2 is connected with the first bias output node h.

It should be noted that, the first light-emitting control terminal Ctrl-1 inputs a first control signal; the second light-emitting control terminal Ctrl-2 inputs a second control signal; where a phase difference between the first control signal and the second control signal is 0 degree or 180 degrees;

The first bias control terminal Ctrl-3 inputs a third control signal; and the second bias control terminal Ctrl-4 inputs a fourth control signal; where a phase difference between the third control signal and the fourth control signal is 0 degree.

In the above-described solution, the pixel circuit comprises the first sub-pixel circuit and the second sub-pixel circuit adjacent to each other, where the first sub-pixel circuit includes the OLED1 and the first data input unit, and the second sub-pixel circuit includes the OLED2 and the second data input unit. The pixel circuit further comprises the light-emitting control unit and the first reverse bias unit. In one frame of image, the first data input unit and the second data input unit are controlled by the scanning terminal, the light-emitting control unit is controlled by the timing signals of the first light-emitting control terminal and the second light-emitting control terminal, and the first reverse bias unit is controlled by the timing signals of the first bias control terminal and the second bias control terminal. Thus, reverse biasing performed by the first driving signal of the first sub-pixel circuit on the OLED2 of the second sub-pixel circuit is implemented and/or reverse biasing performed by the second driving signal of the second sub-pixel circuit on the OLED1 of the first sub-pixel circuit is implemented. Therefore, the OLED1 of the first sub-pixel circuit or the OLED2 of the second sub-pixel circuit does not have to be in the direct current bias condition for a long time, which slows down aging of the OLED1 of the first sub-pixel circuit and/or the OLED2 of the second sub-pixel circuit, and increases the service time of the OLED1 of the first sub-pixel circuit and/or the OLED2 of the second sub-pixel circuit. The pixel circuit provided by the embodiments of the present disclosure does not have any other reverse bias voltage connected therewith externally, but uses the first driving signal of the first sub-pixel circuit as the reverse bias voltage of the OLED2 of the second sub-pixel circuit or the second driving signal of the second sub-pixel circuit as the reverse bias voltage of the OLED1 of the first sub-pixel circuit. Therefore, it is possible to slow down the circuit aging effect of the OLED1 of the first sub-pixel circuit and the OLED2 of the second sub-pixel circuit without affecting the AMOLED display effect, and at a same time, to reduce the wiring difficulty of the pixel circuit and the influence of crosstalk of the bias voltage line on other signal lines.

Embodiment Three

With reference to FIG. 3, FIG. 5, FIG. 7, FIG. 8, FIG. 9, FIG. 10 and FIG. 11, an embodiment of the present disclosure provides a driving method of a pixel circuit 10.

A case where the first light-emitting control transistor T1, the second light-emitting control transistor T2, the first data input transistor T3, the second data input transistor T4, the first driving transistor T5, the second driving transistor T6, the first reverse bias transistor T7 and the second reverse bias transistor T8 in the pixel circuit 10 are transistors of a same type is taken as an example. At a same time, it is illustrated with a case where all transistors in the pixel circuit 10 are P-type transistors, and the first bias control terminal Ctrl-3 and the second bias control terminal Ctrl-4 are connected with a same signal control line as an example.

Figure 7:
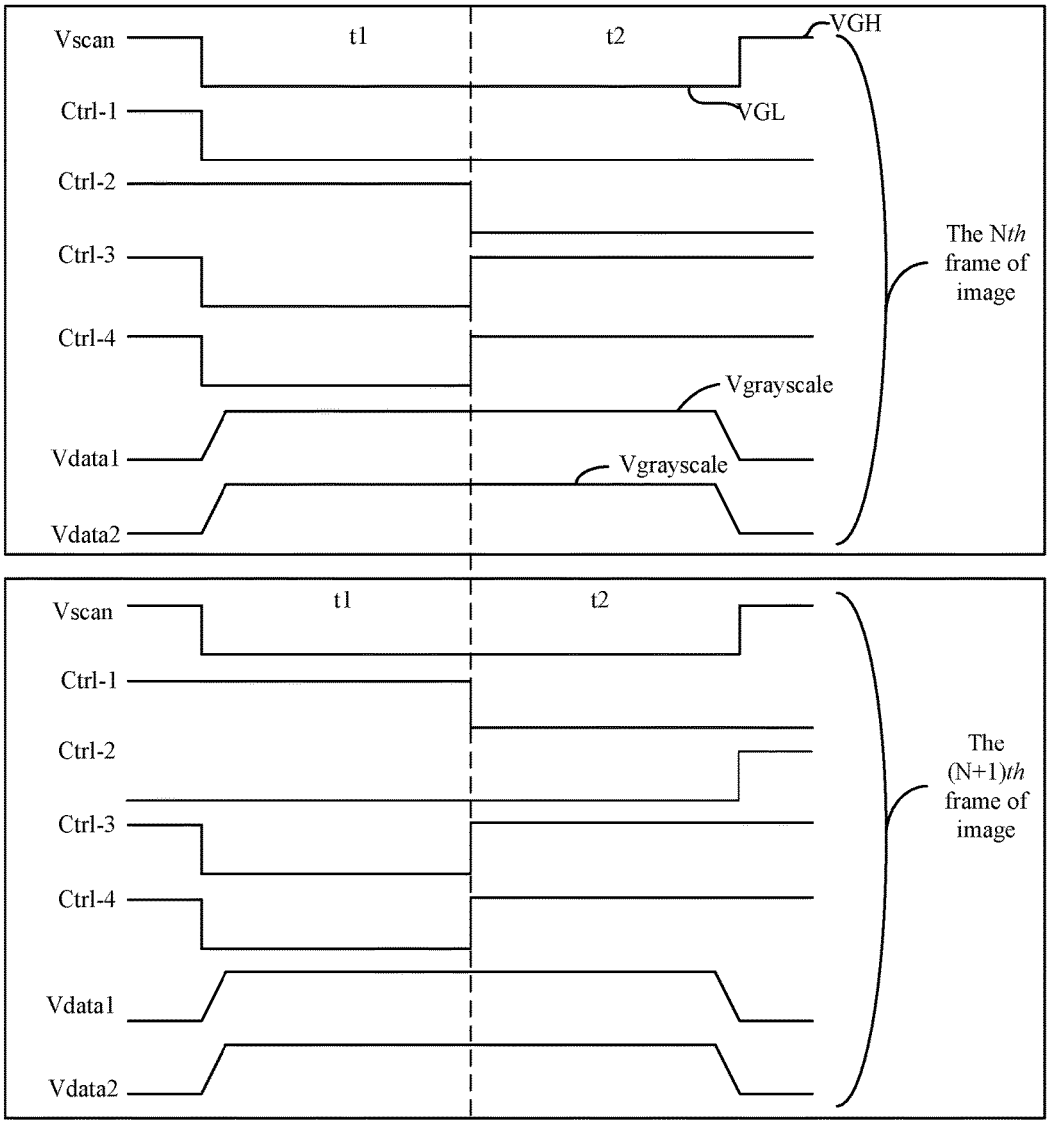
FIG. 7 is a circuit timing schematic diagram of a pixel circuit provided by an embodiment of the present disclosure.

A first time period t1 and a second time period t2 together form a duration of one frame of image, the time periods of t1 and t2 may be respectively used for adjusting time periods for reverse biasing of the first light-emitting unit 201 and the second light-emitting unit 301, and a timing diagram of a corresponding circuit is shown in FIG. 7.

It should be noted that, a first light-emitting control terminal Ctrl-1 inputs a first control signal, and a second light-emitting control terminal Ctrl-2 inputs a second control signal; where a phase difference between the first control signal and the second control signal is 180 degrees. The first bias control terminal Ctrl-3 inputs a third control signal, and the second bias control terminal Ctrl-4 inputs a fourth control signal; where a phase difference between the third control signal and the fourth control signal is 0 degree. In FIG. 7, VGL refers to a low voltage level, VGH refers to a high voltage level, and Vgrayscale refers to a grayscale voltage. In the pixel circuit 10 provided by the embodiments of the present disclosure, a driving signal of the first light-emitting unit 201 (or the second light-emitting unit 301) is used as a reverse bias voltage of an OLED2 of the second light-emitting unit 301 (or an OLED1 of the first light-emitting unit 201). For example, a voltage value of a VSS is generally about −6 V, and a range of the driving signal of the first light-emitting unit 201 or the second light-emitting unit 301 is generally 0 V to 5 V, and at a low grayscale, the driving signal of the first light-emitting unit 201 (or the second light-emitting unit 301) is also a high voltage with respect to the VSS, and reverse biasing may be performed on the OLED2 of the second light-emitting unit 301 (or the OLED1 of the first light-emitting unit 201).

When the pixel circuit 10 provided by the embodiments of the present disclosure is displaying an Nth frame of image and an (N+1)th frame of image (N being an arbitrary positive integer), the pixel circuit 10 may repeatedly perform operations in a first time period t1 of the Nth frame, a second time period t2 of the Nth frame, a first time period t1 of the (N+1)th frame, and a second time period t2 of the (N+1)th frame. Within a time duration of adjacent two frames of image, reverse biasing or direct current charging are performed on the OLED1 of the first light-emitting unit 201 and the OLED2 of the second light-emitting unit 301 respectively within time periods when the pixel circuit 10 operates in the first time period t1 of the Nth frame and the first time period t1 of the (N+1)th frame; and direct current charging is performed on the OLED1 of the first light-emitting unit 201 and the OLED2 of the second light-emitting unit 301 respectively within time periods when the pixel circuit 10 operates in the second time period t2 of the Nth frame and the second time period t2 of the (N+1)th frame.

Scenario One: as shown in FIG. 3, FIG. 5, FIG. 7 and FIG. 8, a method below is executed within the first time period t1 of the Nth frame:

controlling the first light-emitting unit 201 of the first sub-pixel circuit 20 to emit light by a first driving signal;

controlling a first reverse bias unit 50 by the first bias control terminal Ctrl-3, to conduct a first drive node e and a first bias output node h and transmit the first driving signal from the first drive node e to the first bias output node h;

controlling the first reverse bias unit 50 by the second bias control terminal Ctrl-4, to conduct a second drive node f and a second bias output node g;

where:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

a signal of the first light-emitting control terminal Ctrl-1 controls a light-emitting control unit 40, to conduct the first voltage terminal VDD and a first light-emitting control node c, and to output a voltage level of the first voltage terminal VDD to the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node b;

a second storage capacitor CS2 is used for storing a voltage level between the second sub-pixel node b and the first voltage terminal VDD;

a signal of the second light-emitting control terminal Ctrl-2 controls the light-emitting control unit 40, to disconnect the first voltage terminal VDD from a second light-emitting control node d;

a voltage level of the second voltage terminal VSS is transmitted to the second bias output node g and the first bias output node h.

At this point, as shown in FIG. 3 and FIG. 5, in the pixel circuit 10, the first light-emitting control transistor T1 is in a turning-on state; the second light-emitting control transistor T2 is in a turning-off state; the first data input transistor T3 is in the turning-on state; the second data input transistor T4 is in the turning-on state; the first driving transistor T5 is in the turning-on state; the first organic light-emitting diode OLED1 is in a light-emitting state; the second driving transistor T6 is in the turning-off state; the second organic light-emitting diode OLED2 is in a reverse biased state; the first reverse bias transistor T7 is in the turning-on state; and the second reverse bias transistor T8 is in the turning-on state.

Figure 8:
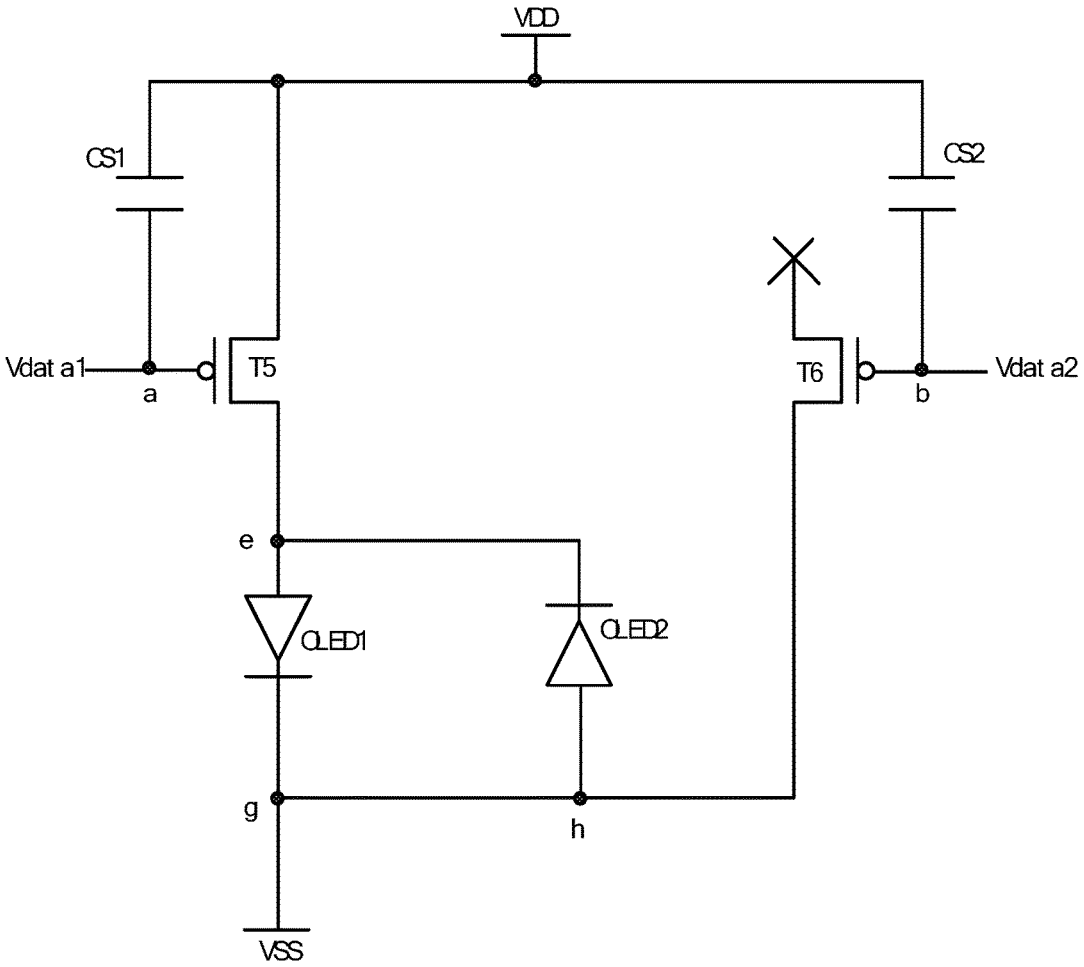
FIG. 8 is a schematic diagram of an equivalent structure of a pixel circuit provided by an embodiment of the present disclosure.

As it can be seen from the above-described solution, when the pixel circuit comprises the first sub-pixel circuit and the second sub-pixel circuit adjacent to each other, and in the first time period t1 of the Nth frame of image, with reference to FIG. 5 and FIG. 7, and when the scanning terminal Vscan is at the low voltage level, the T3 and the T4 are turned on at this time since the T3 and the T4 are the P-type transistors; when the Ctrl-1 is at the low voltage level, T1 is turned on at this time since the T1 is the P-type transistor; when the Ctrl-2 is at the high voltage level, the T2 is turned off at this time since the T2 is the P-type transistor; when the Ctrl-3 is at the low voltage level, the T7 is turned on at this time since the T7 is the P-type transistor; and when the Ctrl-4 is at the low voltage level, the T8 is turned on at this time since the T8 is the P-type transistor. At this time, an equivalent circuit is shown in FIG. 8. The Vdata1 and the Vdata2 respectively input the first data signal and the second data signal to the first sub-pixel node a and the second sub-pixel node b, and at this time, the CS1 stores the voltage level between the first sub-pixel node a and the VDD, the CS2 stores the voltage level between the second sub-pixel node b and the VDD; the T1 transmits the data signal of the VDD to the node c; the data signal of the VSS is transmitted to the node g and the node h; at this time, under actions of the node a, the node c and the node g, the T5 outputs the first driving signal to the node e, to drive the OLED1 to emit light, and the OLED1 is in a direct current charged state within a time period of t1; at a same time, the T7 transmits the first driving signal at the node e to the cathode of the OLED2; since the first driving signal is a high voltage with respect to the VSS, the OLED2 at this time is in the reverse biased state within the time period of t1; and since the T2 is in the turning-off state at this time, direct current biasing may not be performed on the OLED2.

Scenario Two: as shown in FIG. 3, FIG. 5, FIG. 7 and FIG. 9, a method below is executed within the second time period t2 of the Nth frame:

controlling the OLED1 in the first light-emitting unit 201 of the first sub-pixel circuit 20 to emit light by the first driving signal;

controlling the OLED2 in the second light-emitting unit 301 of the second sub-pixel circuit 30 to emit light by the second driving signal;

controlling the first reverse bias unit 50 by the first bias control terminal Ctrl-3, to disconnect the first drive node e from the first bias output node h; and controlling the first reverse bias unit 50 by the second bias control terminal Ctrl-4, to disconnect the second drive node f from the second bias output node g;

where:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

a signal of the first light-emitting control terminal Ctrl-1 controls a light-emitting control unit 40, to conduct the first voltage terminal VDD and a first light-emitting control node c, and to output the voltage level of the first voltage terminal VDD to the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node b;

a second storage capacitor CS2 is used for storing a voltage level between the second sub-pixel node b and the first voltage terminal VDD;

the signal of the second light-emitting control terminal Ctrl-2 controls the light-emitting control unit 40, to conduct the first voltage terminal VDD and the second light-emitting control node d and to transmit the voltage level of the first voltage terminal VDD to the second light-emitting control node d.

At this time, as shown in FIG. 3 and FIG. 5, in the pixel circuit 10, the first light-emitting control transistor T1 and the second light-emitting control transistor T2 are in the turning-on state; the first data input transistor T3 is in the turning-on state; the second data input transistor T4 is in the turning-on state; the first driving transistor T5 is in the turning-on state; the first organic light-emitting diode OLED1 is in the light-emitting state; the second driving transistor T6 is in the turning-off state; the second organic light-emitting diode OLED2 is in the reverse biased state; the first reverse bias transistor T7 is in the turning-off state; and the second reverse bias transistor T8 is in the turning-off state.

Figure 9:
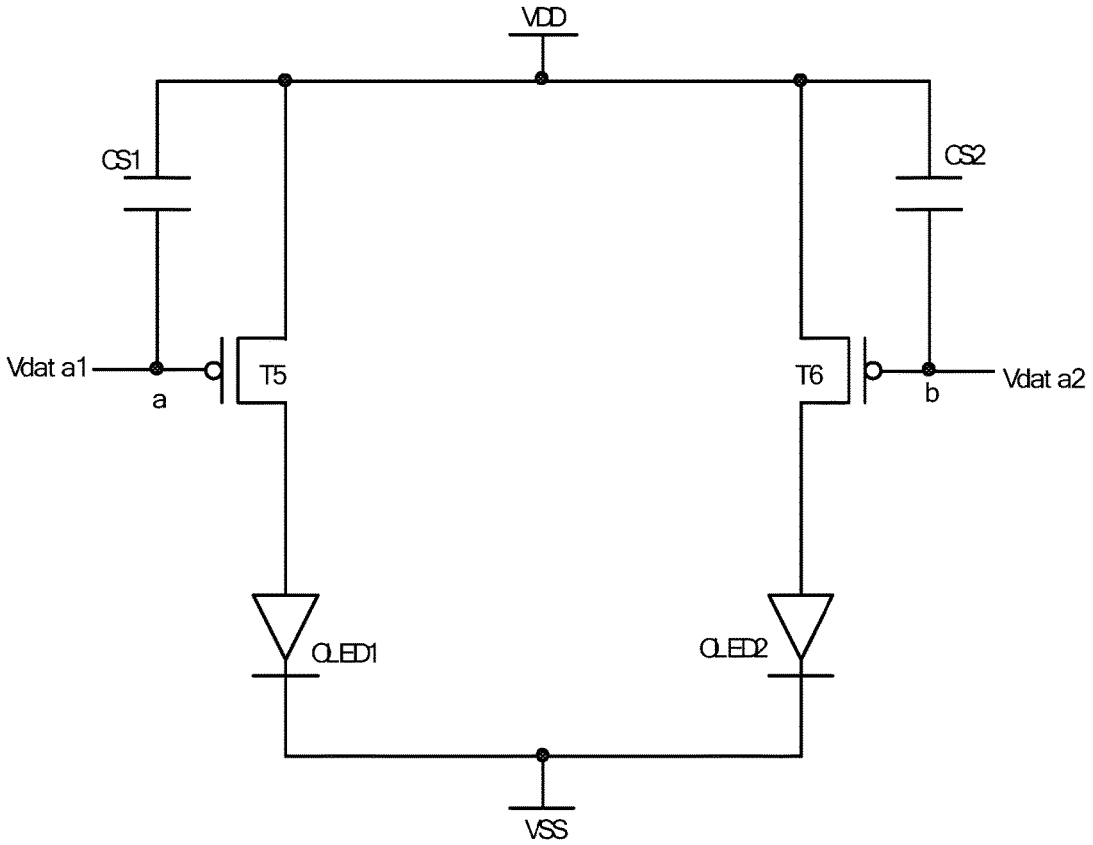
FIG. 9 is a schematic diagram of another equivalent structure of a pixel circuit provided by an embodiment of the present disclosure.

As it can be seen from the above-described solution, when the pixel circuit comprises the first sub-pixel circuit and the second sub-pixel circuit adjacent to each other, and in the second time period t2 of the Nth frame of image, with reference to FIG. 5 and FIG. 7, and when the scanning terminal Vscan is at the low voltage level, the T3 and the T4 are turned on at this time since the T3 and the T4 are the T-type transistors; when the Ctrl-1 is at the low voltage level, since the T1 is the P-type transistor, the T1 is turned on at this time; when the Ctrl-2 is at the low voltage level, since the T2 is the P-type transistor, the T2 is turned on at this time; when the Ctrl-3 is at the high voltage level, since the T7 is the P-type transistor, the T7 is turned off at this time; and when the Ctrl-4 is at the high voltage level, since the T8 is the P-type transistor, the T8 is turned off at this time. At this time, an equivalent circuit is shown in FIG. 9. The Vdata1 and the Vdata2 respectively input the first data signal and the second data signal to the first sub-pixel node a and the second sub-pixel node b, and at this time, the CS1 stores the voltage level between the first sub-pixel node a and the VDD, the CS2 stores the voltage level between the second sub-pixel node b and the VDD; the T1 transmits the data signal of the VDD to the first light-emitting control node c; the T2 transmits the data signal of the VDD to the second light-emitting control node d; the data signal of the VSS is transmitted to the node g and the node h; at this time, under actions of the nodes a, c and g, the T5 outputs the first driving signal to the node e, to drive the OLED1 to emit light, and the OLED1 is in a direct current charged state within a time period of t2; under actions of the nodes b, d and h, the T6 transmits the second driving signal to the node f, to drive the OLED2 to emit light, and the OLED2 is in the direct current charged state of within the time period of t2; the T7 and the T8 are in the turning-off state, which may not make the driving signal of the T5 to perform reverse biasing on the OLED2 or make the driving signal of the T6 to perform reverse biasing on the OLED1, and the OLED1 and the OLED2 themselves are driven by the first driving signal and the second driving signal generated by the TS and the T6 to emit light respectively.

Scenario Three: as shown in FIG. 3, FIG. 5, FIG. 7 and FIG. 10, a method below is executed within the first time period t1 of the (N+1)th frame:

controlling the second light-emitting unit 301 of the second sub--pixel circuit 30 to emit light by the second driving signal;

controlling the first reverse bias unit 50 by the second bias control terminal Ctrl-4, to conduct the second drive node f and the second bias output node g, and to transmit the second driving signal of the second drive node f to the second bias output node g;

controlling the first reverse bias unit 50 by the first bias control terminal Ctrl-3, to conduct the first drive node e and the first bias output node h;

where:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

the signal of the first light-emitting control terminal Ctrl-1 controls the light-emitting control unit 40, to disconnect the first voltage terminal VDD from the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node b;

the second storage capacitor CS2 is used for storing the voltage level between the second sub-pixel node c and the first voltage terminal VDD;

a signal of the second light-emitting control terminal Ctrl-2 controls the light-emitting control unit 40, to conduct the first voltage terminal VDD and the second light-emitting control node d and to transmit the voltage level of the first voltage terminal VDD to the second light-emitting control node d; and a voltage level of the second voltage terminal VSS is transmitted to the second bias output node g and the first bias output node h.

At this time, as shown in FIG. 3 and FIG. 5, in the pixel circuit 10 the first light-emitting control transistor T1 is in the turning-off state; the second light-emitting control transistor T2 is in the turning-on state; the first data input transistor T3 is in the turning-on state the second data input transistor T4 is in the turning-on state; the first driving transistor T5 is in the turning-off state; the first organic light-emitting diode OLED1 is in the reverse biased state; the second driving transistor T6 is in the turning-on state; the second organic light-emitting diode OLED2 is in the light-emitting state; the first reverse bias transistor T7 is in the turning-on state; and the second reverse bias transistor T8 is in the turning-on state.

Figure 10:
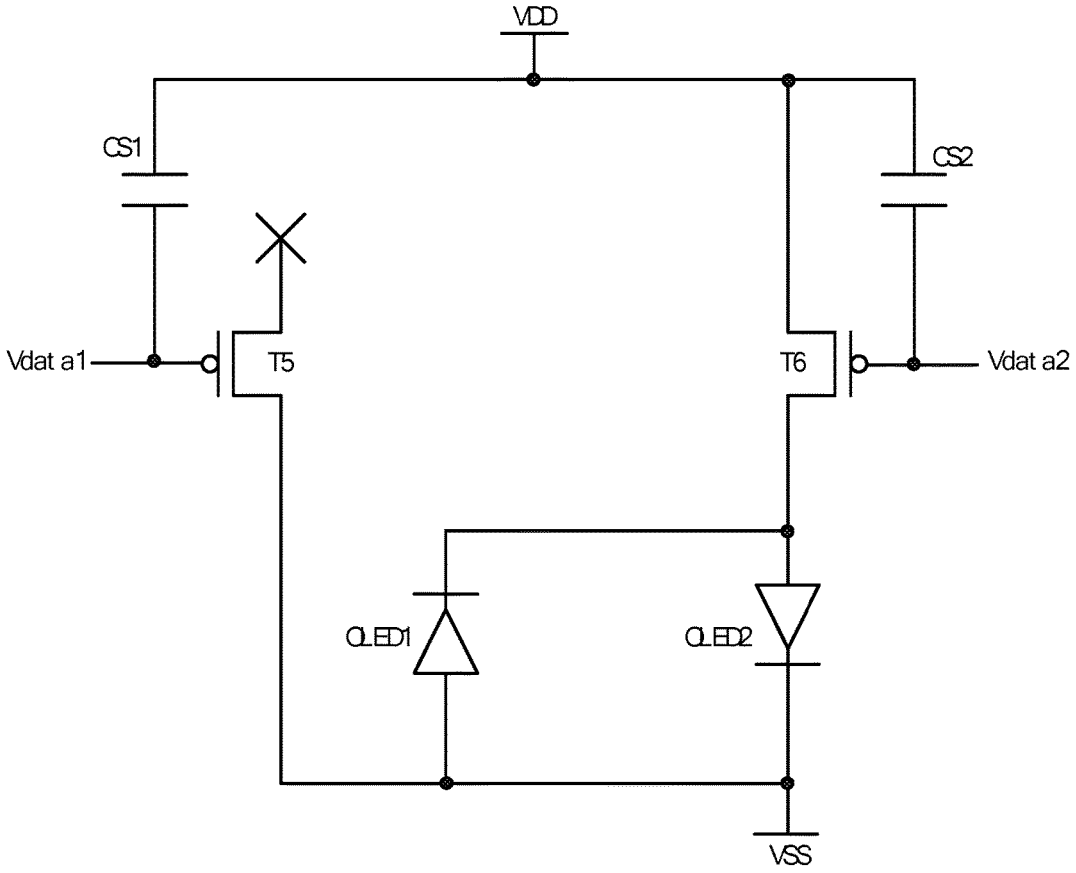
FIG. 10 is a schematic diagram of yet another equivalent structure of a pixel circuit provided by an embodiment of the present disclosure.

As it can be seen from the above-described solution, when the pixel circuit comprises the first sub-pixel circuit and the second sub-pixel circuit adjacent to each other, and in the first time period t1 of the (N+1)th frame of image, with reference to FIG. 5 and FIG. 7, and when the scanning terminal Vscan is at the low voltage level, since the T3 and the T4 are the P-type transistors, the T3 and the T4 are turned on at this time; when the Ctrl-1 is at the high voltage level, since the T1 is the P-type transistor, the T1 is turned off at this time; when the Ctrl-2 is at the low voltage level, since the T2 is the P-type transistor, the T2 is turned on at this time; when the Ctrl-3 is at the low voltage level, since the T7 is the P-type transistor, the T7 is turned on at this time; when the Ctrl-4 is at the low voltage level, since the T8 is the P-type transistor, the T8 is turned on at this time. At this time, an equivalent circuit is shown in FIG. 10. The Vdata1 and the Vdata2 respectively input the first data signal and the second data signal to the first sub-pixel node a and the second sub-pixel node h, and at this time, the CS1 stores the voltage level between the first sub-pixel node a and the VDD, the CS2 stores the voltage level between the second sub-pixel node b and the VDD; the T2 transmits the data signal of the VDD to the node d; at this time, under actions of the nodes b, d and h, the T6 transmits the second driving signal to the node f, to drive the OLED2 to emit light, and the OLED2 is in the direct current charged state within the time period of t1; at a same time, the T8 transmits the second driving signal from the node f to the cathode of the OLED 1; since the second driving signal is a high voltage with respect to the VSS, the OLED1 at this time is in the reverse biased state within the time period of t1; and since the T1 is in the turning-off state at this time, direct current biasing may not be performed on the OLED1.

Scenario Four: as shown in FIG. 3, FIG. 5, FIG. 7 and FIG. 11, a method below is executed within the second time period t2 of the (N+1)th frame:

controlling the first light-emitting unit 201 of the first sub-pixel circuit 20 to emit light by a first driving signal;

controlling the second light-emitting unit 301 of the second sub-pixel circuit 30 to emit light by the second driving signal;

controlling the first reverse bias unit 50 by the first bias control terminal Ctrl-3, to disconnect the first drive node e from the first bias output node h; and controlling the first reverse bias unit 50 by the second bias control terminal Ctrl-4, to disconnect the second drive node f from the second bias output node g;

where;

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

a signal of the first light-emitting control terminal Ctrl-1 controls a light-emitting control unit 40, to conduct the first voltage terminal VDD and a first light-emitting control node c, and to output the voltage level of the first voltage terminal VDD to the first light-emitting control node c;

the signal of the scanning terminal Vscan controls a second data input unit 302, to conduct a second data terminal Vdata2 and a second sub-pixel node h, and to transmit a second data signal of the second data terminal Vdata2 to the second sub-pixel node b;

a second storage capacitor CS2 is used for storing a voltage level between the second sub-pixel node b and the first voltage terminal VDD;

a signal of the second light-emitting control terminal Ctrl-2 controls the light-emitting control unit 40, to conduct the first voltage terminal VDD and the second light-emitting control node d and to transmit the voltage level of the first voltage terminal VDD to the second light-emitting control node d.

At this time, as shown in FIG. 3 and FIG. 5, in the pixel circuit 10, the first light-emitting control transistor T1 and the second light-emitting control transistor T2 are in the turning-on state; the first data input transistor T3 is in the turning-on state; the second data input transistor T4 is in the turning-on state; the first driving transistor T5 is in the turning-on state; the first organic light-emitting diode OLED1 is in the light-emitting state; the second driving transistor T6 is in the turning-off state; the second organic light-emitting diode OLED2 is in the reverse biased state; the first reverse bias transistor T7 is in the turning-off state; and the second reverse bias transistor T8 is in the turning-off state.

Figure 11:
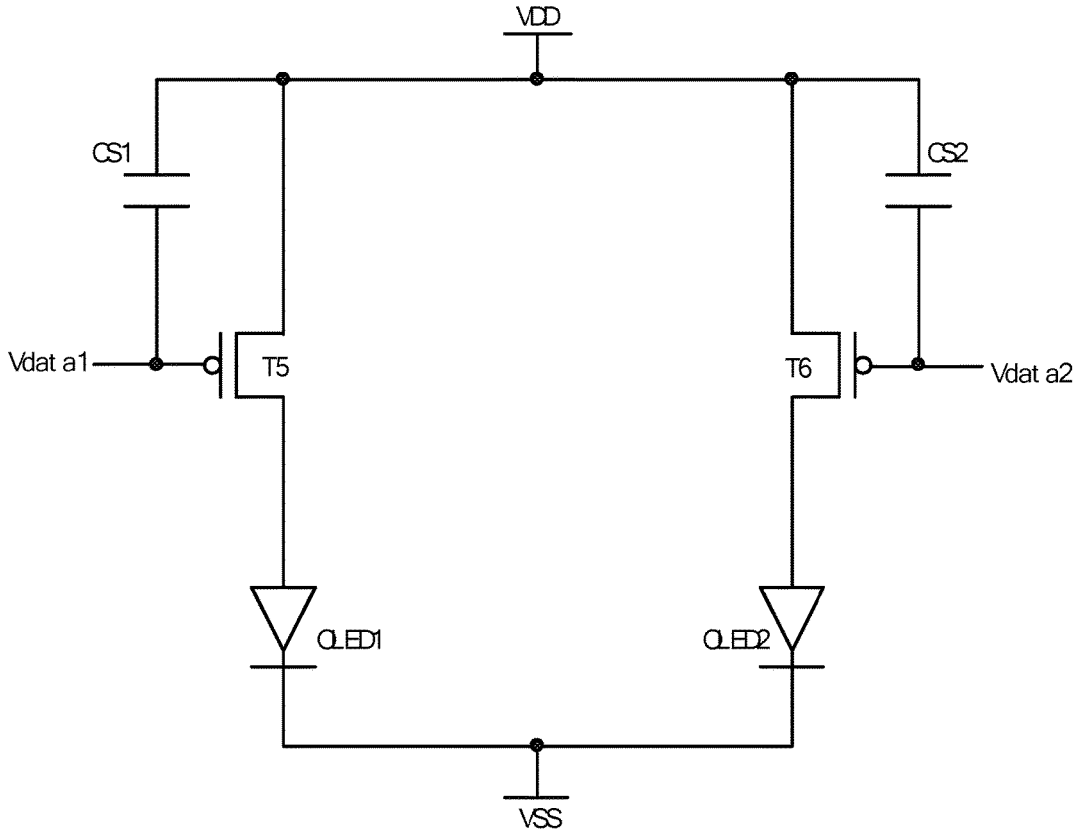
FIG. 11 is a schematic diagram of still yet another equivalent structure of a pixel circuit provided by an embodiment of the present disclosure.

As it can be seen from the above-described solution, when the pixel circuit comprises the first sub-pixel circuit and the second sub-pixel circuit adjacent to each other, and in the second time period t2 of the (N+1)th frame of image, with reference to FIG. 5 and FIG. 7 and when the scanning terminal Vscan is at the low voltage level, since the T3 and the T4 are the P-type transistors, the T3 and the T4 are turned on at this time; when the Ctrl-1 is at the low voltage level, since the T1 is the P-type transistor, the T1 is turned on at this time; when the Ctrl-2 is at the low voltage level, since the T2 is the P-type transistor, the T2 is turned on at this time; when the Ctrl-3 is at the high voltage level, since the T7 is the P-type transistor, the T7 is turned off at this time; when the Ctrl-4 is at the high voltage level, since the T8 is the P-type transistor, the T8 is turned off at this time. At this time, an equivalent circuit is shown in FIG. 11. The Vdata1 and the Vdata2 respectively input the first data signal and the second data signal to the first sub-pixel node a and the second sub-pixel node b, and at this time, the storage capacitor CS1 stores the voltage level between the first sub-pixel node a and the VDD, the storage capacitor CS2 stores the voltage level between the second sub-pixel node b and the VDD; the T1 transmits the data signal of the VDD to the node c; the T2 transmits the data signal of the VDD to the node d; the data signal of the VSS is transmitted to the node g and the node h; at this time, under actions of the nodes a, c and g, the T5 outputs the first driving signal to the node e, to drive the OLED1 to emit light, and the OLED1 is in a direct current charged state within the time period of t2; under actions of the nodes b, d and h, the T6 transmits the second driving signal to the node f, to drive the OLED2 to emit light, and the OLED2 is in the direct current charged state within the time period of t2; the T7 and the T8 are in the turning-off state, which may not make the driving signal of the T5 to perform reverse biasing on the OLED2 or make the driving signal of the T6 to perform reverse biasing on the OLED1. The OLED1 and the OLED2 themselves are driven by the first driving signal and the second driving signal generated by the T5 and the T6 to emit light.

Embodiment Four

With reference to FIG. 4, FIG. 6, FIG. 7, FIG. 8, FIG. 9, FIG. 10 and FIG. 11, an embodiment of the present disclosure provides a driving method of a pixel circuit 10.

A case where a first light-emitting control transistor T1, a second light-emitting control transistor T2, a first data input transistor T3, a second data input transistor T4, a first driving transistor T5, a second driving transistor T6, a first reverse bias transistor T7, a second reverse bias transistor T8, a third reverse bias transistor T9, and a fourth reverse bias transistor T10 in the pixel circuit 10 are transistors of a same type is taken as an example. At a same time, it is illustrated with a case where all transistors in the pixel circuit 10 are P-type transistors, and a first bias control terminal Ctrl-3 and a second bias control terminal Ctrl-4 are connected with a same signal control line as an example. A first time period t1 and a second time period t2 together form a time duration for one frame of image, time periods of t1 and t2 may be used for adjusting the time for reverse biasing of a first light-emitting unit 201 and a second light-emitting unit 301, and a timing diagram of a corresponding circuit is shown in FIG. 7.

It should be noted that, a first light-emitting control terminal Ctrl-1 inputs a first control signal, and a second light-emitting control terminal Ctrl-2 inputs a second control signal; where a phase difference between the first control signal and the second control signal is 180 degrees. The first bias control terminal Ctrl-3 inputs a third control signal, and the second bias control terminal Ctrl-4 inputs a fourth control signal; where a phase difference between the third control signal and the fourth control signal is 0 degree. In FIG. 7, VGL refers to a low voltage level, VGH refers to a high voltage level, and Vgrayscale refers to a grayscale voltage. In the pixel circuit 10 provided by an embodiment of the present disclosure, a driving signal of the first light-emitting unit 201 (or the second light-emitting unit 301) is used as a reverse bias voltage of an OLED2 of the second light-emitting unit 301 (or an OLED1 of the first light-emitting unit 201). For example, a voltage value of a VSS is generally about −6 V, and a range of the driving signal of the first light-emitting unit 201 or the second light-emitting unit 301 is generally 0 V to 5 V; and at a low grayscale, the driving signal of the first light-emitting unit 201 (or the second light-emitting unit 301) is also a high voltage with respect to VSS, and reverse biasing may be performed on the OLED2 of the second light-emitting unit 301 (or the OLED1 of the first light-emitting unit 201).

When the pixel circuit 10 provided by an embodiment of the present disclosure is displaying an Nth frame of image and an (N+1)th frame of image, the pixel circuit 10 may repeatedly perform operations a first time period t1 of the Nth frame, a second time period t2 of the Nth frame, a first time period t1 of the (N+1)th frame, and a second time period t2 of the (N+1)th frame. Within a time duration of adjacent two frames of image, reverse biasing or direct current charging are performed on the OLED1 of the first light-emitting unit 201 and the OLED2 of the second light-emitting unit 301 respectively within time periods when the pixel circuit 10 operates in the first time period t1 of the Nth frame and the first time period t1 of the (N+1)th frame; and direct current charging is performed on the OLED1 of the first light-emitting unit 201 and the OLED2 of the second light-emitting unit 301 respectively within time periods when the pixel circuit 10 operates in the second time period t2 of the Nth frame and the second time period t2 of the (N+1)th frame.

Scenario One: as shown in FIG. 4, FIG. 6, FIG. 7 and FIG. 8, a method below is executed within the first time period t1 of the Nth frame:

controlling the first light-emitting unit 201 of the first sub-pixel circuit 20 to emit light by a first driving signal;

controlling a first reverse bias unit 50 by the first bias control terminal Ctrl-3, to conduct a first drive node e and a first bias output node h, and to transmit the first driving signal of the first drive node e to the first bias output node h;

controlling the first reverse bias unit 50 by the second bias control terminal Ctrl-4, to conduct a second drive node f and a second bias output node g;

wherein:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

a signal of the first light-emitting control terminal Ctrl-1 controls a light-emitting control unit 40, to conduct the first voltage terminal VDD and a first light-emitting control node c, and to output the voltage level of the first voltage terminal VDD to the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node b;

a second storage capacitor CS2 is used for storing a voltage level between the second sub-pixel node b and the first voltage terminal VDD;

a signal of the second light-emitting control terminal Ctrl-2 controls the light-emitting control unit 40, to disconnect the first voltage terminal VDD from a second light-emitting control node d;

the signal of the first light-emitting control terminal Ctrl-1, controls a second reverse bias unit 60, to conduct a second voltage terminal VSS and the second bias output node g, and to output a voltage level of the second voltage terminal VSS to the second bias output node g; and the signal of the second light-emitting control terminal Ctrl-2 controls the second reverse bias unit 60, to disconnect the second voltage terminal VSS from the first bias output node h.

At this time, as shown in FIG. 4 and FIG. 6, in the pixel circuit 10, the first light-emitting control transistor T1 is in a turning-on state; the second light-emitting control transistor T2 is in a turning-off state; the first data input transistor T3 is in the turning-on state; the second data input transistor T4 is in the turning-on state; the first driving transistor T5 is in the turning-on state; the first organic light-emitting diode OLED1 is in a light-emitting state; the second driving transistor T6 is in the turning-off state; the second organic light-emitting diode OLED2 is in a reverse biased state; the first reverse bias transistor T7 is in the turning-on state; the second reverse bias transistor T8 is in the turning-on state; the third reverse bias transistor T9 is in the turning-on state; and the fourth reverse bias transistor T10 is in the turning-off state.

As it can be seen from the above-described solution, when the pixel circuit comprises the first sub-pixel circuit and the second sub-pixel circuit adjacent to each other, and in the first time period t1 of the Nth frame of image, with reference to FIG. 6 and FIG. 7, and when the scanning terminal Vscan is at the low voltage level, since the T3 and the T4 are the P-type transistors, the T3 and the T4 are turned on at this time; when the Ctrl-1 is at the low voltage level, since the T1 and the T9 are the P-type transistors, the T1 and the T9 are turned on at this time; when the Ctrl-2 is at the high voltage level, since the T2 and the T10 are the P-type transistors, the T2 and the T10 are turned off at this time; when the Ctrl-3 is at the low voltage level, since the T7 is the P-type transistor, the T7 is turned on at this time; when the Ctrl-4 is at the low voltage level, since the T8 is the P-type transistor, the T8 is turned on at this time. At this time, an equivalent circuit is shown in FIG. 8. The Vdata1 and the Vdata2 respectively input the first data signal and the second data signal to the first sub-pixel node a and the second sub-pixel node h, and at this time, the storage capacitor CS1 stores the voltage level between the node a and the VDD, the storage capacitor CS2 stores the voltage level between the node b and the VDD; the T1 transmits the data signal of the VDD to the node c; the T9 transmits the data signal of the VSS to the node g; at this time, under actions of the nodes a, c and g, the T5 outputs the first driving signal to the node e, to drive the OLED1 to emit light, and the OLED1 is in a direct current charged state within a time period of t1; at a same time, the T7 transmits the first driving signal at the node e to the cathode of the OLED2; since the first driving signal is a high voltage with respect to the VSS, the OLED2 at this time is in the reverse biased state within the time period of t1; and since the T2 is in the turning-off state at this time, direct current biasing may not be performed on the OLED2.

Scenario Two: as shown in FIG. 4, FIG. 6, FIG. 7 and FIG. 9, a method below is executed within the second time period t2 of the Nth frame:

controlling the first light-emitting unit 201 of the first sub-pixel circuit 20 to emit light by a first driving signal;

controlling the second light-emitting unit 301 of the second sub-pixel circuit 30 to emit light by the second driving signal;

controlling the first reverse bias unit 50 by the first bias control terminal Ctrl-3, to disconnect the first drive node e from the first bias output node h; and controlling the first reverse bias unit 50 by the second bias control terminal Ctrl-4, to disconnect the second drive node f from the second bias output node g;

where:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

a signal of the first light-emitting control terminal Ctrl-1 controls a light-emitting control unit 40, to conduct the first voltage terminal VDD and a first light-emitting control node c, and to output the voltage level of the first voltage terminal VDD to the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node b;

a second storage capacitor CS2 is used for storing a voltage level between the second sub-pixel node b and the first voltage terminal VDD;

the signal of the second light-emitting control terminal Ctrl-2 controls the light-emitting control unit 40, to conduct the first voltage terminal VDD and the second light-emitting control node d and to transmit the voltage level of the first voltage terminal VDD to the second light-emitting control node d;

the signal of the first light-emitting control terminal Ctrl-1 controls a second reverse bias unit 60, to conduct a second voltage terminal VSS and the second bias output node g, and to output a voltage level of the second voltage terminal VSS to the second bias output node g; and the signal of the second light-emitting control terminal Ctrl-2 controls the second reverse bias unit 60, to conduct the second voltage terminal VSS and the first bias output node h, and to output the voltage level of the second voltage terminal VSS to the first bias output node h.

At this time, as shown in FIG. 4 and FIG. 6, in the pixel circuit 10, the first light-emitting control transistor T1 and the second light-emitting control transistor T2 are in the turning-on state; the first data input transistor T3 is in the turning-on state; the second data input transistor T4 is in the turning-on state; the first driving transistor T5 is in the turning-on state; the first organic light-emitting diode OLED1 is in the light-emitting state; the second driving transistor T6 is in the turning-off state; the second organic light-emitting diode OLED2 is in the reverse biased state; the first reverse bias transistor T7 is in the turning-off state; the second reverse bias transistor T8 is in the turning-off state; the third reverse bias transistor T9 is in the turning-on state; and the fourth reverse bias transistor T10 is in the turning-off state.

As it can be seen from the above-described solution, when the pixel circuit comprises the first sub-pixel circuit and the second sub-pixel circuit adjacent to each other, and in the second time period t2 of the Nth frame of image, with reference to FIG. 6 and FIG. 7, and when the scanning terminal Vscan is at the low voltage level, since the T3 and the T4 are the P-type transistors, the T3 and the T4 are turned on at this time; when the Ctrl-1 is at the low voltage level, since the T1 and the T9 are the P-type transistors, the T1 and the T9 are turned on at this time; when the Ctrl-2 is at the low voltage level, since the T2 and the T10 are the P-type transistors, the T2 and the T10 are turned on at this time; when the Ctrl-3 is at the high voltage level, since the T7 is the P-type transistor, the T7 is turned off at this time; when the Ctrl-4 is at the high voltage level, since the T8 is the P-type transistor, the T8 is turned off at this time. At this time, an equivalent circuit is shown in FIG. 9. The Vdata1 and the Vdata2 respectively input the first data signal and the second data signal to the first sub-pixel node a and the second sub-pixel node b, and at this time, the storage capacitor CS1 stores the voltage level between the node a and the VDD, the storage capacitor CS2 stores the voltage level between the node b and the VDD; the T1 transmits the data signal of the VDD to the node c; the T2 transmits the data signal of the VDD to the node d; the T9 transmits the data signal of the VSS to the node g; the T10 transmits the data signal of the VSS to the node h; at this time, under actions of the nodes a, c and g, the T5 outputs the first driving signal to the node e, to drive the OLED1 to emit light, and the OLED1 is in a direct current charged state within a time period of t2; under actions of the nodes b, d and h, the T6 transmits the second driving signal to the node f, to drive the OLED2 to emit light, and the OLED2 is in the direct current charged state within the time period of t2; the T7 and the T8 are in the turning-off state, which may not make the driving signal of the T5 to perform reverse biasing on the OLED2 or make the driving signal of the T6 to perform reverse biasing on the OLED1. The OLED1 and the OLED2 themselves are driven by the first driving signal and the second driving signal generated by the T5 and the T6 to emit light.

Scenario Three: as shown in FIG. 4, FIG. 6, FIG. 7 and FIG. 10, a method below is executed within the first time period t1 of the (N+1)th frame:

controlling the second light-emitting unit 301 of the second sub-pixel circuit 30 to emit light by the second driving signal;

controlling the first reverse bias unit 50 by the second bias control terminal Ctrl-4, to conduct the second drive node f and the second bias output node g, and to transmit the second driving signal of the second drive node f to the second bias output node g;

controlling the first reverse bias unit 50 by the first bias control terminal Ctrl-3, to conduct the first drive node e and the first bias output node h;

where:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

the signal of the first light-emitting control terminal Ctrl-1 controls the light-emitting control unit 40, to disconnect the first voltage terminal VDD from the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node b;

the second storage capacitor CS2 is used for storing the voltage level between a second sub-pixel node c and the first voltage terminal VDD;

a signal of the second light-emitting control terminal Ctrl-2 controls the light-emitting control unit 40, to conduct the first voltage terminal VDD and the second light-emitting control node d and to transmit the voltage level of the first voltage terminal VDD to the second light-emitting control node d; and the signal of the first light-emitting control terminal Ctrl-1 controls the second reverse bias unit 60, to disconnect the second voltage terminal VSS from the second bias output node g; and the signal of the second light-emitting control terminal Ctrl-2 controls the second reverse bias unit 60, to conduct the second voltage terminal VSS and the first bias output node h, and to output the voltage level of the second voltage terminal VSS to the first bias output node h.

At this time, as shown in FIG. 4 and FIG. 6, in the pixel circuit 10, the first light-emitting control transistor T1 is in the turning-off state; the second light-emitting control transistor T2 is in the turning-on state; the first data input transistor T3 is in the turning-on state; the second data input transistor T4 is in the turning-on state; the first driving transistor T5 is in the turning-off state; the first organic light-emitting diode OLED1 is in the reverse biased state; the second driving transistor T6 is in the turning-on state; the second organic light-emitting diode OLED2 is in the light-emitting state; the first reverse bias transistor T7 is in the turning-on state; the second reverse bias transistor T8 is in the turning-on state; the third reverse bias transistor T9 is in the turning-off state; and the fourth reverse bias transistor T10 is in the turning-on state.

As it can be seen from the above-described solution, when the pixel circuit comprises the first sub-pixel circuit and the second sub-pixel circuit adjacent to each other, and in the first time period t1 of the (N−1)th frame of image, with reference to FIG. 6 and FIG. 7, and when the scanning terminal Vscan is at the low voltage level, since the T3 and the T4 are the P-type transistors, the T3 and the T4 are turned on at this time; when the Ctrl-1 is at the high voltage level, since the T1 and the T9 are the P-type transistors, the T1 and the T9 are turned off at this time; when the Ctrl-2 is at the low voltage level, since the T2 and the T10 are the P-type transistors, the T2 and the T10 are turned on at this time; when the Ctrl-3 is at the low voltage level, since the T7 is the P-type transistor, the T7 is turned on at this time; when the Ctrl-4 is at the low voltage level, since the T8 is the P-type transistor, the T8 is turned on at this time. At this time, an equivalent circuit is shown in FIG. 10. The Vdata1 and the Vdata2 respectively input the first data signal and the second data signal to the first sub-pixel node a and the second sub-pixel node b, and at this time, the storage capacitor CS1 stores the voltage level between the node a and the VDD, the storage capacitor CS2 stores the voltage level between the node b and the VDD; the T2 transmits the data signal of the VDD to the node d; at this time, under actions of the nodes b, d and h, the T6 transmits the second driving signal to the node f, to drive the OLED2 to emit light, and the OLED2 is in the direct current charged state within the time period of t1; and at a same time, the T8 transmits the second driving signal from the node f to the cathode of the OLED1. Since the second driving signal is a high voltage with respect to the VSS, the OLED1 at this time is in the reverse biased state within the time period of t1; and since the T1 is in the turning-off state at this time, direct current biasing may not be performed on the OLED1.

Scenario Four: as shown in FIG. 4, FIG. 6, FIG. 7 and FIG. 11, a method below is executed within the second time period t2 of the (N+1)th frame:

controlling the first light-emitting unit 201 of the first sub-pixel circuit 20 to emit light by a first driving signal;

controlling the second light-emitting unit 301 of the second sub-pixel circuit 30 to emit light by the second driving signal;

controlling the first reverse bias unit 50 by the first bias control terminal Ctrl-3, to disconnect the first drive node e from the first bias output node h; and controlling the first reverse bias unit 50 by the second bias control terminal Ctrl-4, to disconnect the second drive node f from the second bias output node g;

where:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

a signal of the first light-emitting control terminal Ctrl-1 controls a light-emitting control unit 40, to conduct the first voltage terminal VDD and a first light-emitting control node c, and to output the voltage level of the first voltage terminal VDD to the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node b;

a second storage capacitor CS2 is used for storing a voltage level between the second sub-pixel node b and the first voltage terminal VDD;

the signal of the second light-emitting control terminal Ctrl-2 controls the light-emitting control unit 40, to conduct the first voltage terminal VDD and the second light-emitting control node d and to transmit the voltage level of the first voltage terminal VDD to the second light-emitting control node d;

the signal of the first light-emitting control terminal Ctrl-1 controls a second reverse bias unit 60, to conduct a second voltage terminal VSS and the second bias output node g, and to output a voltage level of the second voltage terminal VSS to the second bias output node g; and the signal of the second light-emitting control terminal Ctrl-2 controls the second reverse bias unit 60, to conduct the second voltage terminal VSS and the first bias output node h, and to output the voltage level of the second voltage terminal VSS to the first bias output node h.

At this time, as shown in FIG. 4 and FIG. 6, in the pixel circuit 10, the first light-emitting control transistor T1 and the second light-emitting control transistor T2 are in the turning-on state; the first data input transistor T3 is in the turning-on state; the second data input transistor T4 is in the turning-on state; the first driving transistor T5 is in the turning-on state; the first organic light-emitting diode OLED1 is in the light-emitting state; the second driving transistor T6 is in the turning-off state; the second organic light-emitting diode OLED2 is in the reverse biased state; the first reverse bias transistor T7 is in the turning-off state; the second reverse bias transistor T8 is in the turning-off state; the third reverse bias transistor T9 is in the turning-on state; and the fourth reverse bias transistor T10 is in the turning-off state.

As it can be seen from the above-described solution, when the pixel circuit comprises the first sub-pixel circuit and the second sub-pixel circuit adjacent to each other, and in the second time period t2 of the (N+1)th frame of image, with reference to FIG. 6 and FIG. 7, and when the scanning terminal Vscan is at a low voltage level, since the T3 and the T4 are the P-type transistors, the T3 and the T4 are turned on at this time; when the Ctrl-1 is at the low voltage level, since the T1 is the P-type transistor, T1 is turn on at this time; when the Ctrl-2 is at the low voltage level, since the T2 is the P-type transistor, T2 is turn on at this time; when the Ctrl-3 is at the high voltage level, since the T7 is the P-type transistor, the T7 is turned off at this time; when the Ctrl-4 is at the high voltage level, since the T8 is the P-type transistor, the T8 is turned off at this time. At this time, an equivalent circuit is shown in FIG. 11. The Vdata1 and the Vdata2 respectively input the first data signal and the second data signal to the first sub-pixel node a and the second sub-pixel node b, and at this time, and at this time, the storage capacitor CS1 stores the voltage level between the node a and the VDD, the storage capacitor CS2 stores the voltage level between the node b and the VDD; the T1 transmits the data signal of the VDD to the node c; the T2 transmits the data signal of the VDD to the node d; the data signal of the VSS is transmitted to the nodes g and h; at this time, under actions of the nodes a, c and g, the T5 outputs the first driving signal to the node e, to drive the OLED1 to emit light, and the OLED1 is in the direct current charged state within the time period of t2; under actions of the nodes b, d and h, the T6 transmits the second driving signal to the node f, to drive the OLED2 to emit light, and the OLED2 is in the direct current charged state within the time period of t2; the T7 and the T8 are in the turning-off state, which may not make the driving signal of the T5 to perform reverse biasing on the OLED2 and/or make the driving signal of the T6 to perform reverse biasing on the OLED1. The OLED1 and the OLED2 themselves are driven by the first driving signal and the second driving signal generated by the T5 and the T6 to emit light.

With combined reference to Scenarios One, Two, Three and Four in Embodiment Three and Scenarios One, Two, Three and Four in Embodiment Four as described above, it can be known that the pixel circuit 10 provided by embodiments of the present disclosure comprises the first sub-pixel circuit and the second sub-pixel circuit, and all the transistors in the pixel circuit 10 are the P-type transistors. The phase difference between the control signals input by the first light-emitting control terminal Ctrl-1 and the second light-emitting control terminal Ctrl-2 is 180 degrees; and the phase difference between the control signals input by the first bias control terminal Ctrl-3 and the second bias control terminal Ctrl-4 is 0 degree; that is, the first bias control terminal Ctrl-3 and the second bias control terminal Ctrl-4 are connected with a same control line, and may implement control of the T7 and the T8 without being connected with two control lines, which reduces the number of data lines, and reduces the wiring difficulty of the pixel circuit 10. At a same time, at the time periods t1 and t2 in a same frame of image, under the control of the scanning terminal Vscan, the first light-emitting control terminal Ctrl-1, the second light-emitting control terminal Ctrl-2, the first bias control terminal Ctrl-3 and the second bias control terminal Ctrl-4: the OLED2 of the second sub-pixel circuit 30 is in the reverse biased state as driven by the first driving signal of the first sub-pixel circuit 20, and the time period of the reverse biased state is t1; or the OLED1 of the first sub-pixel circuit 20 is in the reverse biased state as driven by the second driving signal of the second sub-pixel circuit 30, and the time period of the reverse biased state is t1. In addition, the OLED1 of the first sub-pixel circuit 20 may be subjected to direct current charging in the first time period t1 of the Nth frame, the second time period t2 of the Nth frame and the second time period t2 of the (N+1)th frame, and a total time period for which the OLED1 is in the direct current charged state is t1+2*t2; and the OLED2 of the second sub-pixel circuit 30 may be subjected to direct current charging in the first time period t1 of the Nth frame, the second time period t2 of the (N+1)th frame and the second time period t2 of the (N−1)th frame, and a total time period for which the OLED2 is in the direct current charged state is t1+2*t2. Therefore, the OLED1 of the first sub-pixel circuit 20 or the OLED2 of the second sub-pixel circuit 30 does not have to be in a direct current bias condition for a long time, which slows down aging of the OLED1 of the first sub-pixel circuit 20 and the OLED2 of the second sub-pixel circuit 30, and increases service time of the OLED1 of the first sub-pixel circuit 20 and the OLED2 of the second sub-pixel circuit 30. The pixel circuit 10 provided by the embodiments of the present disclosure does not have any other reverse bias voltage connected therewith externally; but by using the first driving signal of the first sub-pixel circuit 20 and/or the second driving signal of the second sub-pixel circuit 30 as the reverse bias voltage of the OLED2 of the second sub-pixel circuit 30 and/or the reverse bias voltage of the OLED1 of the first sub-pixel circuit 20, the pixel circuit 10 slows down a circuit aging effect of the OLED1 of the first sub-pixel circuit 20 and the OLED2 of the second sub-pixel circuit 30 without affecting an AMOLED display effect, and at a same time, reduces the wiring difficulty of the pixel circuit 10 and influence of crosstalk of a bias voltage line on other signal lines.

Embodiment Five

Figure 12:
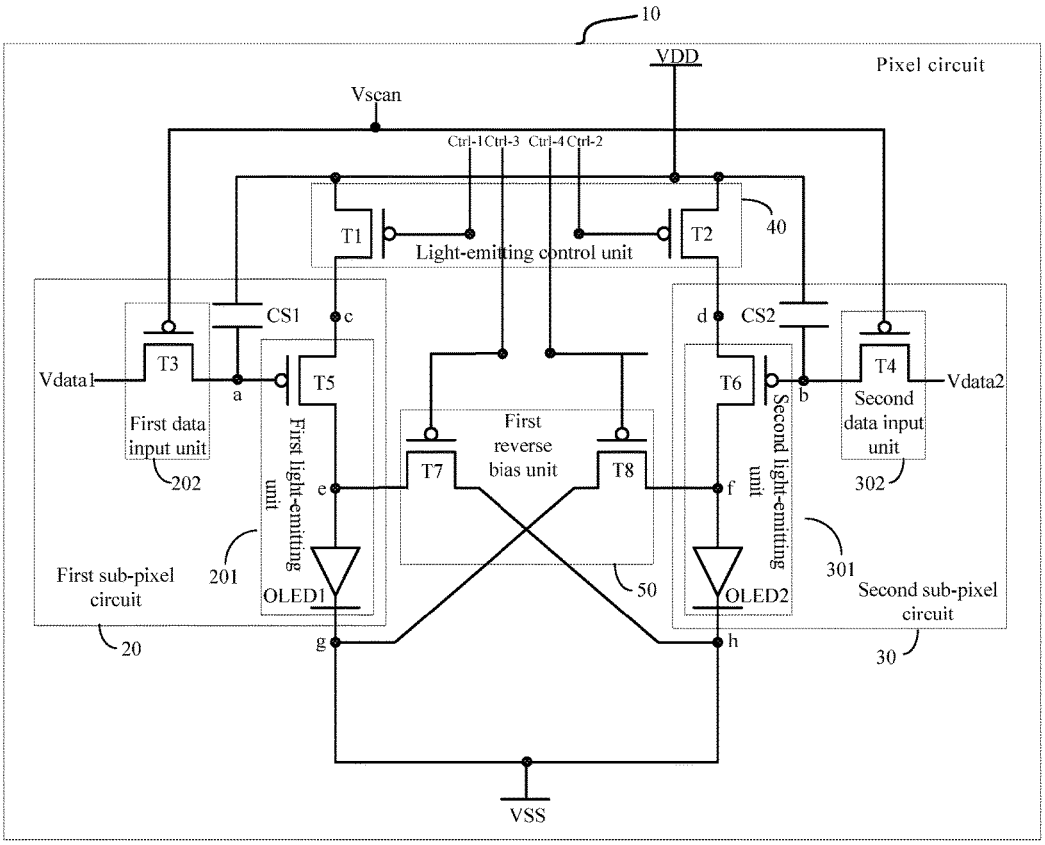
FIG. 12 is a structural schematic diagram of yet another example implementation of a pixel circuit provided by an embodiment of the present disclosure.
Figure 13:
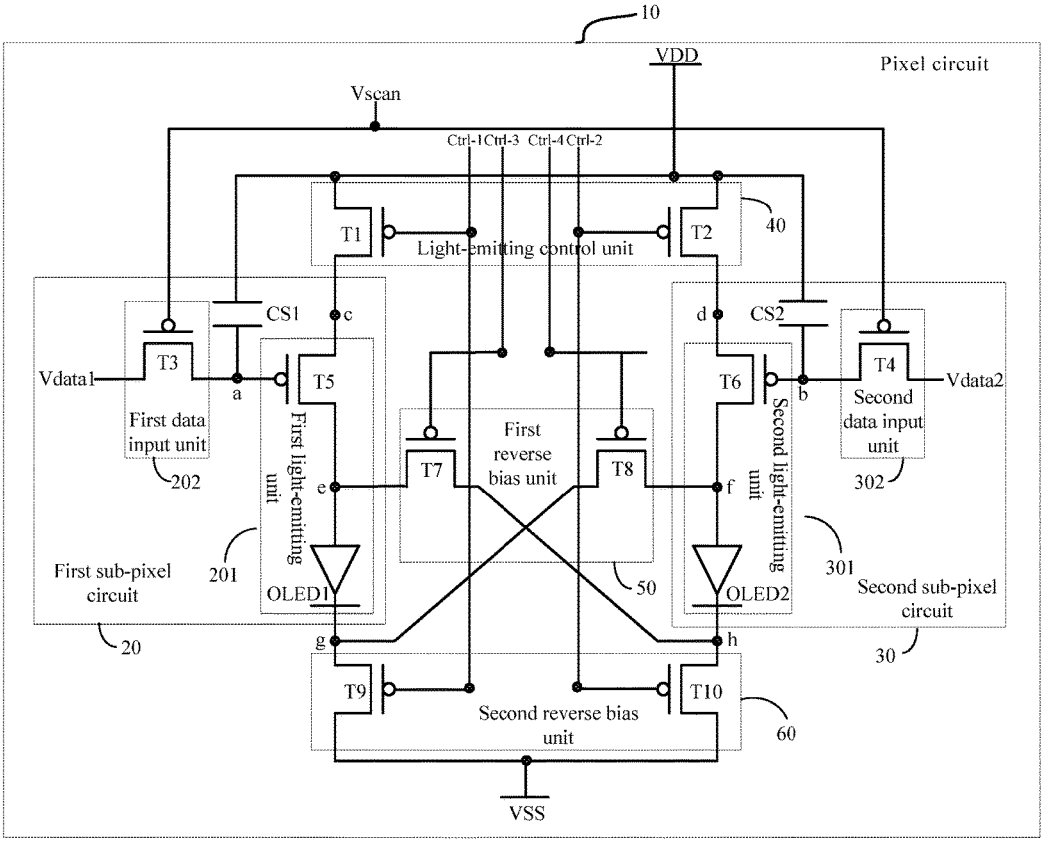
FIG. 13 is a structural schematic diagram of still yet another example implementation of a pixel circuit provided by an embodiment of the present disclosure.
Figure 14:
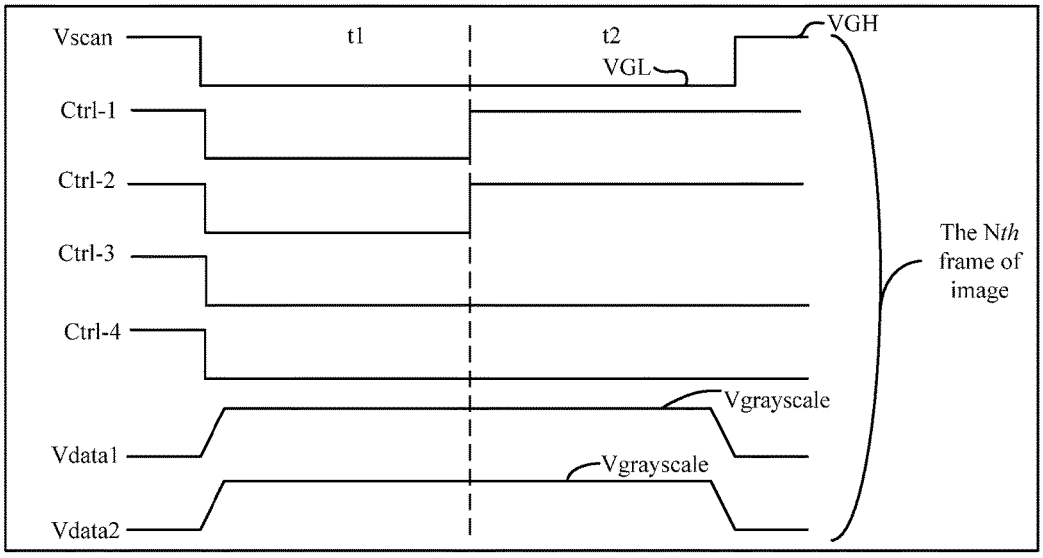
FIG. 14 is a circuit timing diagram of a pixel circuit provided by an embodiment of the present disclosure.

With reference to FIG. 3, FIG. 4, FIG. 12, FIG. 13, FIG. 14, FIG. 15 and FIG. 16, an embodiment of the present disclosure provides a driving method of a pixel circuit 10. A case is taken as an example where a first light-emitting control transistor T1, a first data input transistor T3, a second data input transistor T4, a first driving transistor T5, a second driving transistor T6, a first reverse bias transistor T7, and a second reverse bias transistor T8 are transistors of a type being different from that of a second light-emitting control transistor T2. At a same time, it is illustrated with the following case as an example where: the first light-emitting control transistor T1, the first data input transistor T3, the second data input transistor T4, the first driving transistor T5, the second driving transistor T6, the first reverse bias transistor T7, and the second reverse bias transistor T8 in the pixel circuit 10 are P-type transistors; the second light-emitting control transistor T2 is an N-type transistor; a first light-emitting control terminal Ctrl-1 and a second light-emitting control terminal Ctrl-2 are connected with a same signal control line; and a first bias control terminal Ctrl-3 and a second bias control terminal Ctrl-4 are connected with a same signal control line. A first time period t1 and a second time period t2 together form a time duration for one frame of image, time periods of t1 and t2 may be used for adjusting the time for reverse biasing of a first light-emitting unit 201 and a second light-emitting unit 301, and a timing diagram of a corresponding circuit is shown in FIG. 14.

It should be noted that, the first light-emitting control terminal Ctrl-1 inputs a first control signal, and the second light-emitting control terminal Ctrl-2 inputs a second control signal; where a phase difference between the first control signal and the second control signal is 0 degree. The first bias control terminal Ctrl-3 inputs a third control signal; and the second bias control terminal Ctrl-4 inputs a fourth control signal; where a phase difference between the third control signal and the fourth control signal is 0 degree. A signal line connecting the first light-emitting control terminal Ctrl-1 and the second light-emitting control terminal Ctrl-2 and a signal line connecting the first bias control terminal Ctrl-3 and the second bias control terminal Ctrl-4 are not a same signal line.

When the pixel circuit 10 provided by the embodiments of the present disclosure is displaying an Nth frame of image, the pixel circuit 10 may repeatedly perform operations in a first time period t1 of the Nth frame and a second time period t2 of the Nth frame. An OLED1 of the first light-emitting unit 201 is subjected to direct current charging when the pixel circuit 10 is operating in the first time period t1 of the Nth frame and is subjected to reverse biasing in the second time period t2 of the Nth frame; an OLED2 of the second light-emitting unit 301 is subjected to reverse biasing when the pixel circuit 10 is operating in the first time period t1 of the Nth frame and is subjected to direct current charging in the second time period t2 of the Nth frame; where time lengths of t1 and t2 may be used for adjusting the reverse biasing time of the OLED1 and the OLED2.

Scenario One: as shown in FIG. 3, FIG. 12, FIG. 14 and FIG. 15 a method below is executed within the first time period t1 of the Nth frame:

controlling the first light-emitting unit 201 of the first sub-pixel circuit 20 to emit light by a first driving signal;

controlling a first reverse bias unit 50 by the first bias control terminal Ctrl-3, to conduct a first drive node e and a first bias output node h, and to transmit the first driving signal of the first drive node e to the first bias output node h;

controlling the first reverse bias unit 50 by the second bias control terminal Ctrl-4, to conduct a second drive node f and a second bias output node g;

where:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

a signal of the first light-emitting control terminal Ctrl-1 controls a light-emitting control unit 40, to conduct the first voltage terminal VDD and a first light-emitting control node c, and to output the voltage level of the first voltage terminal VDD to the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node b;

a second storage capacitor CS2 is used for storing a voltage level between the second sub-pixel node b and the first voltage terminal VDD;

a signal of the second light-emitting control terminal Ctrl-2 controls the light-emitting control unit 40, to disconnect the first voltage terminal VDD from a second light-emitting control node d; and a voltage level of the second voltage terminal VSS is transmitted to the second bias output node g and the first bias output node h.

At this time, as shown in FIG. 3 and FIG. 12, in the pixel circuit 10, the first light-emitting control transistor T1 is in a turning-on state; the second light-emitting control transistor T2 is in a turning-off state; the first data input transistor T3 is in the turning-on state; the second data input transistor T4 is in the turning-on state; the first driving transistor T5 is in the turning-on state; the first organic light-emitting diode OLED1 is in a light-emitting state; the second driving transistor T6 is in the turning-off state; the second organic light-emitting diode OLED2 is in a reverse biased state; the first reverse bias transistor T7 is in the turning-on state; and the second reverse bias transistor T8 is in the turning-on state.

Figure 15:
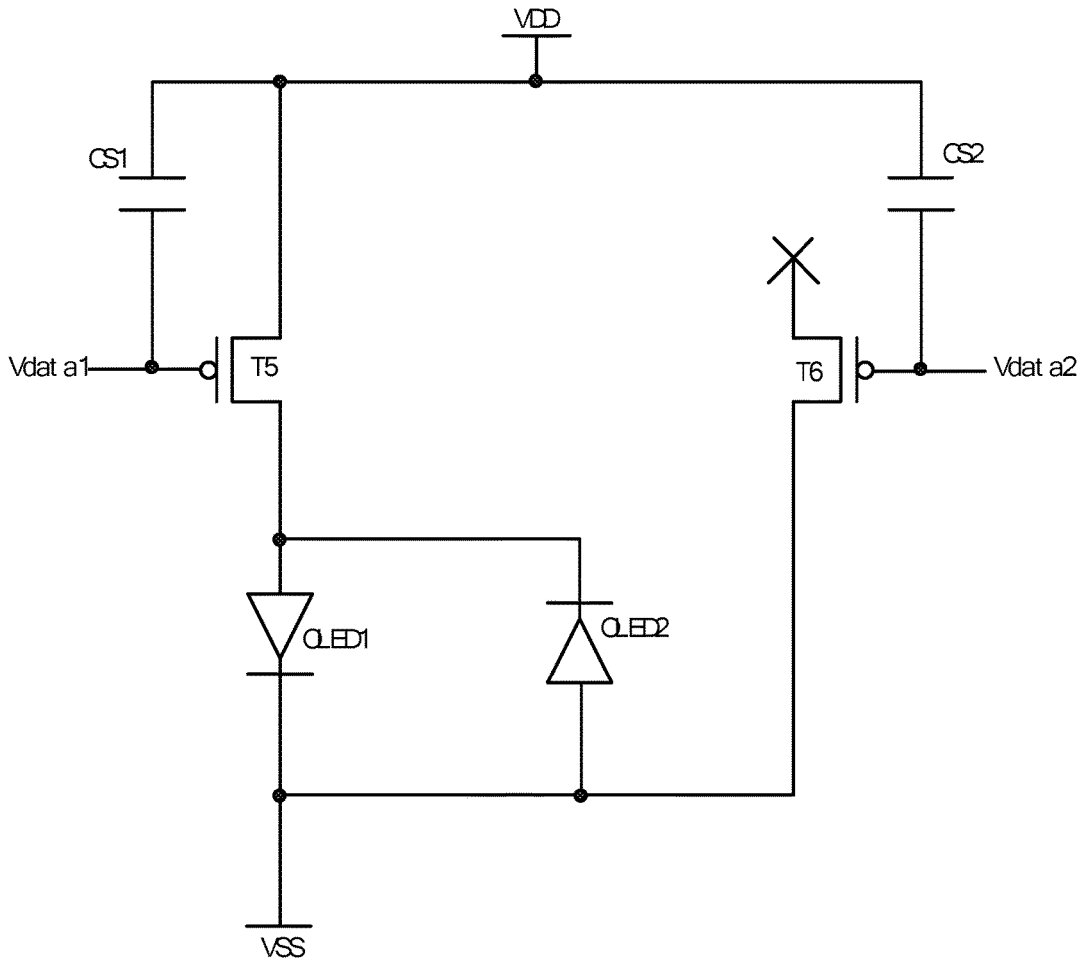
FIG. 15 is a schematic diagram of an equivalent structure of a pixel circuit provided by an embodiment of the present disclosure.

As it can be seen from the above-described solution, when the pixel circuit comprises the first sub-pixel circuit and the second sub-pixel circuit, and in the first time period t1 of the Nth frame of image, with reference to FIG. 13 and FIG. 14, and when the scanning terminal Vscan is at a low voltage level, since the T3 and the T4 are the P-type transistors, the T3 and the T4 are turned on at this time; when the Ctrl-1 is at the low voltage level, since the T1 is the P-type transistor, the T1 is turned on at this time; when the Ctrl-2 is at the low voltage level, since the T2 is the N-type transistor, the T2 is turned off at this time; when the Ctrl-3 is at the low voltage level, since the T7 is the P-type transistor, the T7 is turned on at this time; and when the Ctrl-4 is at the low voltage level, since the T8 is the P-type transistor, the T8 is turned on at this time, At this time, an equivalent circuit is shown in FIG. 15. The Vdata1 and the Vdata2 respectively input the first data signal and the second data signal to the first sub-pixel node a and the second sub-pixel node b, and at this time, the storage capacitor CS1 stores the voltage level between the node a and the VDD, the storage capacitor CS2 stores the voltage level between the node b and the VDD; the T1 transmits the data signal of the VDD to the node c; at this time, under actions of the nodes a, c and g, the T5 outputs the first driving signal to the node e, to drive the OLED1 to emit light, and the OLED1 is in a direct current charged state within a time period of t1; at a same time, the T7 transmits the first driving signal from the node e to a cathode of the OLED2; since the first driving signal is a high voltage with respect to the VSS, the OLED2 at this time is in the reverse biased state within the time period of t1; and since the T2 is in the turning-off state at this time, direct current biasing may not be performed on the OLED2.

Scenario Two: as shown in FIG. 3, FIG. 12, FIG. 14 and FIG. 16, a method below is executed within the second time period t2 of the Nth frame:

controlling the second light-emitting unit 301 of the second sub-pixel circuit 30 to emit light by the second driving signal;

controlling the first reverse bias unit 50 by the second bias control terminal Ctrl-4, to conduct the second drive node f and the second bias output node g, and to transmit the second driving signal of the second drive node f to the second bias output node g; and controlling the first reverse bias unit 50 by the first bias control terminal Ctrl-3, to conduct the first drive node e and the first bias output node h;

where:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

the signal of the first light-emitting control terminal Ctrl-1 controls the light-emitting control unit 40, to disconnect the first voltage terminal VDD from the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node h;

the second storage capacitor CS2 is used for storing the voltage level between a second sub-pixel node c and the first voltage terminal VDD;

a signal of the second light-emitting control terminal Ctrl-2 controls the light-emitting control unit 40, to conduct the first voltage terminal VDD and the second light-emitting control node d and to transmit the voltage level of the first voltage terminal VDD to the second light-emitting control node d; and a voltage level of the second voltage terminal VSS is transmitted to the second bias output node g and the first bias output node h.

At this time, as shown in FIG. 3 and FIG. 12, in the pixel circuit 10, the first light-emitting control transistor T1 is in the turning-off state; the second light-emitting control transistor T2 is in the turning-on state; the first data input transistor T3 is in the turning-on state; the second data input transistor T4 is in the turning-on state; the first driving transistor T5 is in the turning-off state; the first organic light-emitting diode OLED1 is in the reverse biased state; the second driving transistor T6 is in the turning-on state; the second organic light-emitting diode OLED2 is in the light-emitting state; the first reverse bias transistor T7 is in the turning-on state; and the second reverse bias transistor T8 is in the turning-on state.

Figure 16:
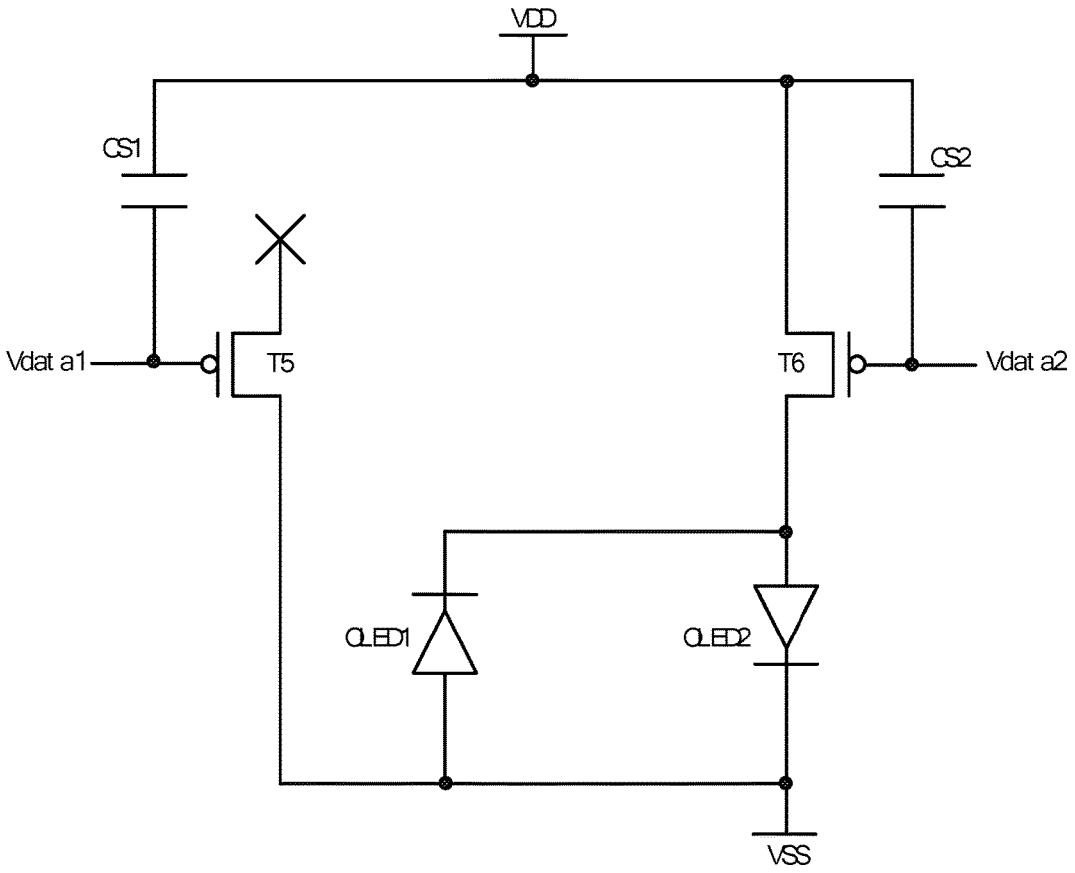
FIG. 16 is a schematic diagram of another equivalent structure of a pixel circuit provided by an embodiment of the present disclosure.

As it can be seen from the above-described solution, when the pixel circuit comprises the first sub-pixel circuit and the second sub-pixel circuit adjacent to each other, and in the second time period 12 of the Nth frame of image, with reference to FIG. 12 and FIG. 14, and when the scanning terminal Vscan is at the low voltage level, since the T3 and the T4 are the P-type transistors, the T3 and the T4 are turned on at this time; when the Ctrl-1 is at a high voltage level, since the T1 is the P-type transistor, T1 is turned off at this time; when the Ctrl-2 is at the high voltage level, since the T2 is the N-type transistor, the T2 is turned on at this time; when the Ctrl-3 is at the low voltage level, since the T7 is the P-type transistor, the T7 is turned on at this time; and when the Ctrl-4 is at the low voltage level, since the T8 is the P-type transistor, the T8 is turned on at this time. At this time, an equivalent circuit is shown in FIG. 16. The Vdata1 and the Vdata2 respectively input the first data signal and the second data signal to the first sub-pixel node a and the second sub-pixel node b, and at this time, the storage capacitor CS1 stores the voltage level between the node a and the VDD, the storage capacitor CS2 stores the voltage level between the node b and the VDD; the T2 transmits the data signal of the VDD to the node d; at this time, under actions of the nodes b, d and h, the T6 outputs the second driving signal to the node f, to drive the OLED2 to emit light, and the OLED2 is in the direct current charged state within the time period of t2; at a same time, the T8 transmits the second driving signal at the node f to the cathode of the OLED1; since the second driving signal is a high voltage with respect to the VSS, the OLED1 at this time is in the reverse biased state within the time period of t2; and since the T1 is in the turning-off state at this time, direct current biasing may not be performed on the OLED1.

Embodiment Six

With reference to FIG. 4, FIG. 13, FIG. 14, FIG. 15 and FIG. 16, an embodiment of the present disclosure provides a driving method of a pixel circuit 10, A case is taken as an example where in the pixel circuit 10 a first light-emitting control transistor T1, a first data input transistor T3, a second data input transistor T4, a first driving transistor T5, a second driving transistor T6, a first reverse bias transistor T7, a second reverse bias transistor T8, a third reverse bias transistor T9 are transistors of a type different from that of a second light-emitting control transistor T2 and a fourth reverse bias transistor T10. At a same time, it is illustrated with the following case as an example where: in the pixel circuit 10, the first light-emitting control transistor T1, the first data input transistor T3, the second data input transistor T4, the first driving transistor T5, the second driving transistor T6, the first reverse bias transistor T7, the second reverse bias transistor T8 and the third reverse bias transistor T9 are P-type transistors; the second light-emitting control transistor T2 and the fourth reverse bias transistor T10 are N-type transistors; a first light-emitting control terminal Ctrl-1 and a second light-emitting control terminal Ctrl-2 are connected with a same signal control line; and a first bias control terminal Ctrl-3 and a second bias control terminal Ctrl-4 are connected with a same signal control line. A first time period t1 and a second time period t2 together form a time duration for one frame of image, time periods of t1 and t2 may be used for adjusting the time for reverse biasing of a first sub-pixel circuit 20 and a second sub-pixel circuit 30, and a timing diagram of a corresponding circuit is shown in FIG. 14.

It should be noted that, the first light-emitting, control terminal Ctrl-1 inputs a first control signal, and the second light-emitting control terminal Ctrl-2 inputs a second control signal; where a phase difference between the first control signal and the second control signal is 0 degree. The first bias control terminal Ctrl-3 inputs a third control signal; and the second bias control terminal Ctrl-4 inputs a fourth control signal; where a phase difference between the third control signal and the fourth control signal is 0 degree. A signal line connecting the first light-emitting control terminal Ctrl-1 and the second light-emitting control terminal Ctrl-2 and a signal line connecting the first bias control terminal Ctrl-3 and the second bias control terminal Ctrl-4 are not a same signal line.

When the pixel circuit 10 provided by the embodiment of the present disclosure is displaying an Nth frame of image, the pixel circuit 10 may repeatedly perform operations in a first time period t1 of the Nth frame and a second time period t2 of the Nth frame. An OLED1 of the first light-emitting unit 201 is subjected to direct current charging when the pixel circuit 10 is operating in the first time period t1 of the Nth frame and is subjected to reverse biasing in the second time period t2 of the Nth frame; an OLED2 of the second light-emitting unit 301 is subjected to reverse biasing when the pixel circuit 10 is operating in the first time period t1 of the Nth frame and is subjected to direct current charging in the second time period t2 of the Nth frame; where a time length of t1 and a time length of t2 may be used for adjusting the reverse biasing time of the OLED1 and the reverse biasing time of the OLED2.

Scenario One: as shown in FIG. 4, FIG. 13, FIG. 14 and FIG. 15, a method below is executed within the first time period t1 of the Nth frame:

controlling the first light-emitting unit 201 of the first sub-pixel circuit 20 to emit light by a first driving signal;

controlling a first reverse bias unit 50 by the first bias control terminal Ctrl-3, to conduct a first drive node c and a first bias output node h, and to transmit the first driving signal of the first drive node e to the first bias output node h;

controlling the first reverse bias unit 50 by the second bias control terminal Ctrl-4, to conduct a second drive node f and a second bias output node g;

where:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing a voltage level between the first sub-pixel node a and a first voltage terminal VDD;

a signal of the first light-emitting control terminal Ctrl-1 controls a light-emitting control unit 40, to conduct the first voltage terminal VDD and a first light-emitting control node e, and to output the voltage level of the first voltage terminal VDD to the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node b;

a second storage capacitor CS2 is used for storing a voltage level between the second sub-pixel node b and the first voltage terminal VDD;

a signal of the second light-emitting control terminal Ctrl-2 controls the light-emitting control unit 40, to disconnect the first voltage terminal VDD from a second light-emitting control node d;

the signal of the first light-emitting control terminal Ctrl-1 controls a second reverse bias unit 60, to conduct a second voltage terminal VSS and the second bias output node g, and to output a voltage level of the second voltage terminal VSS to the second bias output node g; and the signal of the second light-emitting control terminal Ctrl-2 controls the second reverse bias unit 60, to disconnect the second voltage terminal VSS from the first bias output node h.

At this time, as shown in FIG. 4 and FIG. 13, in the pixel circuit 10, the first light-emitting control transistor T1 is in a turning-on state; the second light-emitting control transistor T2 is in a turning-off state; the first data input transistor T3 is in the turning-on state; the second data input transistor T4 is in the turning-off state; the first driving transistor T5 is in the turning-on state; the first organic light-emitting diode OLED is in a light-emitting state; the second driving transistor T6 is in the turning-off state; the second organic light-emitting diode OLED2 is in the reverse biased state; the first reverse bias transistor T7 is in the turning-on state; the second reverse bias transistor T8 is in the turning-on state; the third reverse bias transistor T9 is in the turning-on state; and the fourth reverse bias transistor T10 is in the turning-off state.

As it can be seen from the above-described solution, when the pixel circuit comprises the first sub-pixel circuit and the second sub-pixel circuit adjacent to each other, and in the first time period t1 of the Nth frame of image, with reference to FIG. 13 and FIG. 14, and when the scanning terminal Vscan is at a low voltage level, since the T3 and the T4, are the P-type transistors, the T3 and the T4 are turned on at this time; when the Ctrl-1 is at the low voltage level, since the T1 and the T9 are the P-type transistors, the T1 and the T9 are turned on at this time; when the Ctrl-2 is at the low voltage level, since the T2 and the T10 are the N-type transistors, the T2 and the T10 are turned off at this time; when the Ctrl-3 is at the low voltage level, since the T7 is the P-type transistor, the T7 is turned on at this time; and when the Ctrl-4 is at the low Voltage level, since the T8 is the P-type transistor, the T8 is turned on at this time. At this time, an equivalent circuit is shown in FIG. 15. The Vdata1 and the Vdata2 respectively input the first data signal and the second data signal to the first sub-pixel node a and the second sub-pixel node b, and at this time, the storage capacitor CS1 stores the voltage level between the node a and the VDD, the storage capacitor CS2 stores the voltage level between the node 11 and the VDD; the T1 transmits the data signal of the VDD to the node c; the T9 transmits the data signal of the VSS to the node g; at this time, under actions of the nodes a, c and g, the T5 outputs the first driving signal to the node e, to drive the OLED1 to emit light, and the OLED1 is in a direct current charged state within a time period of t1; at a same time, the T7 transmits the first driving signal at the node e to a cathode of the OLED2; since the first driving signal is a high voltage with respect to the VSS, the OLED2 at this time is in the reverse biased state within the time period of t1; and since the T2 is in the turning-off state at this time, direct current biasing may not be performed on the OLED2.

Scenario Two: as shown in HG. 4, FIG. 13, FIG. 14 and FIG. 16, a method below is executed within the second time period t2 of the Nth frame:

controlling the second light-emitting unit 301 of the second sub-pixel circuit 30 to emit light by the second driving signal;

controlling the first reverse bias unit 50 by the second bias control terminal Ctrl-4, to conduct the second drive node f and the second bias output node g, and to transmit the second driving signal of the second drive node f to the second bias output node g;

controlling the first reverse bias unit 50 by the first bias control terminal Ctrl-3, to conduct the first drive node e and the first bias output node h;

where:

a signal of the scanning terminal Vscan controls a first data input unit 202, to conduct a first data terminal Vdata1 and a first sub-pixel node a, and to transmit a first data signal of the first data terminal Vdata1 to the first sub-pixel node a;

a first storage capacitor CS1 is used for storing it voltage level between the first sub-pixel node a and a first voltage terminal VDD;

the signal of the first light-emitting control terminal Ctrl-1 controls the light-emitting control unit 40, to disconnect the first voltage terminal VDD from the first light-emitting control node c;

the signal of the scanning terminal Vscan controls a second data input unit 302, to conduct a second data terminal Vdata2 and a second sub-pixel node b, and to transmit a second data signal of the second data terminal Vdata2 to the second sub-pixel node b;

the second storage capacitor CS2 is used for storing the voltage level between the second sub-pixel node b and the first voltage terminal VDD;

a signal of the second light-emitting control terminal Ctrl-2, controls the light-emitting control unit 40, to conduct the first voltage terminal VDD and the second light-emitting control node d and to transmit the voltage level of the first voltage terminal VDD to the second light-emitting control node d; and the signal of the first light-emitting control terminal Ctrl-1 controls the second reverse bias unit 60, to disconnect the second voltage terminal VSS from the second bias output node g; and the signal of the second light-emitting control terminal Ctrl-2 controls the second reverse bias unit 60, to conduct the second voltage terminal VSS and the first bias output node h, and to output the voltage level of the second voltage terminal VSS to the first bias output node h.

At this time, as shown in FIG. 4 and FIG. 13, in the pixel circuit 10, the first light-emitting control transistor T1 is in the turning-off state; the second light-emitting control transistor T2 is in the turning-on state; the first data input transistor T3 is in the turning-on state; the second data input transistor T4 is in the turning-on state; the first driving transistor T5 is in the turning-off state; the first organic light-emitting diode OLED1 is in the reverse biased state; the second driving transistor T6 is in the turning-on state; the second organic light-emitting diode OLED2 is in the light-emitting state; the first reverse bias transistor T7 is in the turning-on state; the second reverse bias transistor T8 is in the turning-on state; the third reverse bias transistor T9 is in the turning-off state; and the fourth reverse bias transistor T10 is in the turning-on state.

As it can be seen from the above-described solution, when the pixel circuit comprises the first sub-pixel circuit and the second sub-pixel circuit adjacent to each other, and in the second time period t2 of the Nth frame of image, with reference to FIG. 13 and FIG. 14, and when the scanning terminal Vscan is at the low voltage level, since the T3 and the T4 are the P-type transistors, the T3 and the T4 are turned on at this time; when the Ctrl-1 is at the high voltage level, since the T1 and the T9 are the P-type transistors, the T1 and the T9 are turned off at this time; when the Ctrl-2 is at the high voltage level, since the T2 and the T10 are the N-type transistors, the T2 and the T10 are turned on at this time; when the Ctrl-3 is at the low voltage level, since the T7 is the P-type transistor, the T7 is turned on at this time; when the Ctrl-4 is at the low voltage level, since the T8 is the P-type transistor, the T8 is turned on at this time. At this time, an equivalent circuit is shown in FIG. 16. The Vdata1 and the Vdata2 respectively input the first data signal and the second data signal to the first sub-pixel node a and the second sub-pixel node b, and at this time, the storage capacitor CS1 stores the voltage level between the node a and the VDD, the storage capacitor CS2 stores the voltage level between the node b and the VDD; the T2 transmits the data signal of the VDD to the node d; at this time, under actions of the nodes b, d and h, the T6 transmits the second driving signal to the node f, to drive the OLED2 to emit light, and the OLED2 is in the direct current charged state within a time period of t2; at a same time, the T8 transmits the second driving signal at the node f to the cathode of the OLED1. Since the second driving signal is a high voltage with respect to the VSS, the OLED1 at this time is in the reverse biased state within the time period of t2; and since the T1 is in the turning-off state at this time, direct current biasing may not be performed on the OLED1.

With combined reference to Scenarios One and Two in Embodiment Five and Scenarios One and Two in Embodiment Six as described above, it can be known that the pixel circuit 10 provided by embodiments of the present disclosure comprises the first sub-pixel circuit and the second sub-pixel circuit adjacent to each other. The phase difference between the control signals input by the first light-emitting control terminal Ctrl-1 and the second light-emitting control terminal Ctrl-2 is 0 degree; that is, the first light-emitting control terminal Ctrl-1 and the second light-emitting control terminal Ctrl-2 are connected with a same control line, so that control of turning on and off of the T1 and the T2 may be implemented at different time periods within a same frame of image. The phase difference between the control signals input by the first bias control terminal Ctrl-3 and the second bias control terminal Ctrl-4 is 0 degree; that is, the first bias control terminal Ctrl-3 and the second bias control terminal Ctrl-4 are connected with a same control line, so that control of turning on and off of the T7 and the T8 may be implemented at different time periods within a same frame of image. Thus, the number of signal lines is reduced and a wiring difficulty of the pixel circuit 10 is reduced. Thus, in the pixel circuit 10, the OLED2 of the second sub-pixel circuit 30 is in the reverse biased state as driven by the first driving signal of the first sub-pixel circuit 20, and the time period of the reverse biased state is t1; or, the OLED1 of the first sub-pixel circuit 20 is in the reverse biased state as driven by the second driving signal of the second sub-pixel circuit 30, and the time period of the reverse biased state is t2. In addition, the OLED1 of the first sub-pixel circuit 20 may be subjected to direct current charging, with the direct current charging time of t1; and the OLED2 of the second sub-pixel circuit 30 may be subjected to direct current charging, with the direct current charging time of t2. Since the OLED1 of the first sub-pixel circuit 20 and/or the OLED2 of the second sub-pixel circuit 30 does not have to be in a direct current bias condition for a long time, it is possible to slow down aging of the OLED1 of the first sub-pixel circuit 20 and the OLED2 of the second sub-pixel circuit 30, and to increase service time of the OLED1 of the first sub-pixel circuit 20 and the OLED2 of the second sub-pixel circuit 30. The pixel circuit 10 provided by embodiments of the present disclosure does not have any other reverse bias voltage connected therewith externally; but by using the first driving signal of the first sub-pixel circuit 20 (or the second driving signal of the second sub-pixel circuit 30) as the reverse bias voltage of the OLED2 of the second sub-pixel circuit 30 (or the reverse bias voltage of the OLED1 of the first sub-pixel circuit 20), the pixel circuit 10 in embodiments of the disclosure slows down a circuit aging effect of the OLED1 of the first sub-pixel circuit 20 and the OLED2 of the second sub-pixel circuit 30 without affecting an AMOLED display effect, and at a same time, reduces the wiring difficulty of the pixel circuit 10 and influence of crosstalk of a bias voltage line on other signal lines.

Embodiment Seven

An embodiment of the present disclosure provides a display device, comprising any one of the pixel circuits 10 provided by Embodiment One and Embodiment Two.

It should be noted that, in the pixel circuit provided by the embodiments of the present disclosure, when the pixel circuit performs reverse biasing on an OLED1 of a first sub-pixel circuit 20 or on an OLED2 of a second sub-pixel circuit 30, data signals of a first data terminal Vdata1 and a second data terminal Vdata2 simultaneously perform charging, on a first storage capacitor CS1 and a second storage capacitor CS2, which does not reduce the charging time of the first storage capacitor CS1 and the second storage capacitor CS2. Thus, the pixel circuit 10 provided by the embodiments of the present disclosure is applicable to a high-resolution screen.

In addition, the display device may be: an E-paper, a mobile phone, a tablet personal computer, a television, a monitor, a laptop, a digital photo frame, a navigator, and any other product or component having a display function.

In this text, relation terms such as "first" and "second" are only used for differentiating one entity or operation from another entity or operation without requiring or implying that these entities or operations have any such actual relationship or sequence. In addition, terms "comprise", "include" or other variants mean to cover non-exclusive comprising, so that a process, method, object or device comprising a series of elements not only comprises these elements, but also comprises other unclearly listed elements, or further comprises inherent elements of such a process, method, object or device. Without more limitations, the elements defined by the statement of "comprises a . . . " does not exclude other same elements in the process, method, article and device.

Unless expressly stipulated or defined, terms "mounted", "connected" and "linked" should be broadly understood, for example, they may be fixedly connected, detachably connected, or integrally connected; may be mechanically connected or electrically connected; or may be directly connected, indirectly connected by a medium, or internally communicated between two components. For those ordinarily skilled in the art, the specific meanings of the terms in the present disclosure can be understood according to specific conditions.

Obviously, those skilled in the art may modify the disclosure in various ways without breaking away from the spirits and scope of the disclosure. And so, if these changes and variations of the disclosure also fall within the scope of the claims or their equivalent technologies, the disclosure intends to include these changes and variations.

What are described above is related to the illustrative embodiments of the disclosure only and not limitative to the scope of the disclosure; any changes or replacements easily for those technical personnel who are familiar with this technology in the field to envisage in the scopes of the disclosure, should he in the scope of protection of the present disclosure. Therefore, the scopes of the disclosure are defined by the accompanying claims.

The present application claims the priority of the Chinese Patent Application No. 201610509888.0 filed on Jun. 30, 2016, which is incorporated herein by reference in its entirety as part of the disclosure of the present application.

The invention claimed is:

1. A pixel circuit, comprising: a first reverse bias unit, and a first sub-pixel circuit and a second sub-pixel circuit adjacent to each other, the first sub-pixel circuit including a first light-emitting unit, and the second sub-pixel circuit including a second light-emitting unit; wherein:

the first light-emitting unit is connected with a first drive node, the second light-emitting unit is connected with a first bias output node;

the first reverse bias unit is connected with the first drive node, the first bias output node, and a first bias control terminal; and the first light-emitting unit is configured to emit light under control of a first driving signal, and to output the first driving signal to the first drive node;

the first reverse bias unit is configured to output the first driving signal of the first drive node to the first bas output node under control of the first bias control terminal; and the first bias output node is configured to supply a reverse bias voltage to the second light-emitting unit.

2. The pixel circuit according to claim 1, wherein:

the second light-emitting unit is connected with a second drive node and a second bas output node;

the first reverse bias unit is further connected with the second drive node, the second bias output node and a second bias control terminal;

the second light-emitting unit is configured to emit light under control of a second driving signal, and to output the second driving signal to the second bias output node:

the first reverse bias unit is further configured to output the second driving signal of the second drive node under control of the second bias control terminal; and the second bias output node is configured to supply a reverse bias voltage to the first light-emitting unit.

3. The pixel circuit according to claim 2, wherein:

the first sub-pixel circuit further includes a first data input unit and a first storage capacitor;

the first data input unit is connected with a first data terminal, a scanning terminal and a first sub-pixel node, and the first data input unit is configured to output a first data signal of the first data terminal to the first sub-pixel node under control of a signal of the scanning terminal;

the first storage capacitor is connected with the first sub-pixel node and a first voltage terminal, and the first storage capacitor is configured to store a voltage level between the first sub-pixel node and the first voltage terminal;

the first light-emitting unit is further connected with the first sub-pixel node and a first light-emitting control node, and the first light-emitting unit is configured to output the first driving signal to the first drive node under control of a signal of the first sub-pixel node, a signal of the first light-emitting control node, and a signal of the second bias output node;

the pixel circuit further comprises a light-emitting control unit; the light-emitting control unit is connected with the first voltage terminal, a first light-emitting control terminal, and the first light-emitting control node; and the light-emitting control unit is configured to output a voltage level of the first voltage terminal to the first light-emitting control node under control of the first light-emitting control terminal.

4. The pixel circuit according to claim 3, wherein:

the first data input unit includes a first data input transistor, a gate electrode of the first data input transistor is connected with the scanning terminal, a first terminal of the first data input transistor is connected with the first data terminal and a second terminal of the first data input transistor is connected with the first sub-pixel node; and the light-emitting control unit includes a first light-emitting control transistor, a gate electrode of the first light-emitting control transistor is connected with the first light-emitting control terminal, a first terminal of the first light-emitting control transistor is connected with the first voltage terminal, and a second terminal of the first light-emitting control transistor is connected with the first light-emitting control node.

5. The pixel circuit according to claim 2, wherein:

the second sub-pixel circuit further includes a second data input unit and a second storage capacitor;

the second data input unit is connected with a second data terminal, the scanning terminal and a second sub-pixel node; and the second data input unit is configured to output a second data signal of the second data terminal to the second sub-pixel node under control of the signal of the scanning terminal;

the second storage capacitor is connected with the second sub-pixel node and the first voltage terminal, and the second storage capacitor is configured to store a voltage level between the second sub-pixel node and the first voltage terminal;

the second light-emitting unit is further configured to output the second driving signal to the second drive node under control of a signal of the second sub-pixel node, a signal of a second light-emitting control node and a signal of the first bias output node;

the pixel circuit further comprises a light-emitting control unit, and the light-emitting control unit is connected with the first voltage terminal, a second light-emitting control terminal, and the second light-emitting control node; and the light-emitting control unit is configured to output the voltage level of the first voltage terminal to the second light-emitting control node under control of the second light-emitting control terminal.

6. The pixel circuit according to claim 5, wherein:

the second data input unit includes a second data input transistor, a gate electrode of the second data input transistor is connected with the scanning terminal, a first terminal of the second data input transistor is connected with the second data terminal, and a second terminal of the second data input transistor is connected with the second sub-pixel node; and the light-emitting control unit includes a second light-emitting control transistor, a gate electrode of the second light-emitting control transistor is connected with the second light-emitting control terminal, a first terminal of the second light-emitting control transistor is connected with the first voltage terminal, and a second terminal of the second light-emitting control transistor is connected with the second light-emitting control node.

7. The pixel circuit according to claim 2, wherein the second bias output node and the first bias output node are connected with a second voltage terminal; or the pixel circuit further comprises a second reverse bias unit;

the second reverse bias unit is connected with the second bias output node, the first bias output node, the first light-emitting control terminal, the second light-emitting control terminal, and the second voltage terminal; the second reverse bias unit is configured to output a voltage level of the second voltage terminal to the second bias output node under the control of the first light-emitting control terminal; and the second reverse bias unit is further configured to output the voltage level of the second voltage terminal to the first bias output node under the control of the second light-emitting control terminal.

8. The pixel circuit according to claim 7, wherein:

the second reverse bias unit includes a third reverse bias transistor and a fourth reverse bias transistor, a gate electrode of the third reverse bias transistor is connected with the first light-emitting control terminal, a first terminal of the third reverse bias transistor is connected with the second bias output node, and a second terminal of the third reverse bas transistor is connected with the second voltage terminal; and a gate electrode of the fourth reverse bias transistor is connected with the second light-emitting control terminal, a first terminal of the fourth reverse bias transistor is connected with the first bias output node, and a second terminal of the fourth reverse bias transistor is connected with the second voltage terminal; and the third reverse bias transistor and the fourth reverse bias transistor are transistors of a same type, and the first light-emitting control terminal and the second light-emitting control terminal are connected with different signal control lines; or the third reverse bias transistor and the fourth reverse bias transistor are transistors of different types, and the first light-emitting control terminal and the second light-emitting control terminal are connected with a same signal control line.

9. The pixel circuit according to claim 2, wherein:

the first reverse bias unit includes a first reverse bias transistor and a second reverse bias transistor; a gate electrode of the first reverse bias transistor is connected with the first bias control terminal, a first terminal of the first reverse bias transistor is connected with the first drive node, a second terminal of the first reverse bias transistor is connected with the first bias output node;

a gate electrode of the second reverse bias transistor is connected with the second bias control terminal, a first terminal of the second reverse bias transistor is connected with the second drive node, and a second terminal of the second reverse bias transistor is connected with the second bias output node; and the first bias control terminal and the second bias control terminal are connected with a same signal control one.

10. The pixel circuit according to claim 2, wherein the first light-emitting unit includes a first driving transistor and a first organic light-emitting diode, a gate electrode of the first driving transistor is connected with the first sub-pixel node, a first terminal of the first driving transistor is connected with the first light-emitting control node, a second terminal of the first driving transistor is connected with the first drive node and an anode of the first organic light-emitting diode, and a cathode of the first organic light-emitting diode is connected with the second bias output node.

11. The pixel circuit according to claim 2, wherein the second light-emitting unit includes a second driving transistor and a second organic light-emitting diode, a gate electrode of the second driving transistor is connected with the second sub-pixel node, a first terminal of the second driving transistor is connected with the second light-emitting control node, a second terminal of the second driving transistor is connected with the second drive node and an anode of the second organic light-emitting diode, and a cathode of the second organic light-emitting diode is connected with the first bias output node.

12. A display device, comprising the pixel circuit according to claim 1.

13. A driving method of a pixel circuit, the pixel circuit comprising a first reverse bias unit, and a first sub-pixel circuit and a second sub-pixel circuit adjacent to each to other, wherein the first sub-pixel circuit comprises a first light-emitting unit, and the second sub-pixel circuit comprises a second light-emitting unit;

the first light-emitting unit is connected with a first drive node, the second light-emitting unit is connected with a first bias output node;

the first reverse bias unit is connected with the first drive node, the first bias output, node, and a first bias control terminal;

the first light-emitting unit is or to emit light under control of a first driving signal, and to output the first driving signal first drive node;

the first reverse bias unit is configured to output the first driving signal of the first drive node to the first bias output node under control of the first bias control terminal; and the first bias output node is configured to supply a reverses bias voltage to the second light-emitting unit;

wherein the driving method comprises:

executing operations as follows within a first time period of an Nth frame;

controlling a first light-emitting unit of a first sub-pixel circuit to emit light by a first driving signal;

controlling a first reverse bias unit by a first bias control terminal, to conduct a first drive node and a first bias output node, and to transmit the first driving signal of the first drive node to a first bias output node; and controlling the first reverse bias unit by a second bias control terminal, to conduct a second drive node and a second bias output node;

executing operations as follows within a second time period of the Nth frame:

controlling the first light-emitting unit of the first sub-pixel circuit to emit light by the first driving signal;

controlling a second light-emitting unit of a second sub-pixel circuit to emit light by a second driving signal;

controlling the first reverse bias unit by the first bias control terminal, to disconnect the first drive node from the first bias output node; and controlling the first reverse bias unit by the second bias control terminal, to disconnect the second drive node from the second bias output node;

executing operations as follows within a first time period of an (N+1)th frame:

controlling the second light-emitting unit of the second sub-pixel circuit to emit light by the second driving signal;

controlling the first reverse bias unit by the second bias control terminal, to conduct the second drive node and the second bias output node, and to transmit the second driving signal of the second drive node to the second bias output node; and controlling the first reverse bias unit by the first bias control terminal, to conduct the first drive node and the first bias output node; and executing operations as follows within a second time period of the (N+1)th frame:

controlling the first light-emitting unit of the first sub-pixel circuit to emit light by the first driving signal;

controlling the second light-emitting unit of the second sub-pixel circuit to emit light by the second driving signal;

controlling the first reverse bias unit by the first bias control terminal, to disconnect the first drive node from the first bias output node: and controlling the first reverse bias unit by the second bias control terminal, to disconnect the second drive node from the second bias output node;

wherein N is an integer greater than or equal to 1.

14. The driving method according to claim 13, wherein the first sub-pixel circuit further includes a first data input unit and a first storage capacitor;

the driving method further comprises executing operations as follows within the first time period of the Nth frame, the second time period of the Nth frame, the first time period of the (N+1)th frame and the second time period of the (N+1)th frame, respectively:

controlling the first data input unit by a signal of the scanning terminal, to conduct the first data terminal and the first sub-pixel node, and to transmit the first data signal of the first data terminal to the first sub-pixel node; and storing a voltage level between the first sub-pixel node and the first voltage terminal by the first storage capacitor.

15. The driving method according to claim 13, wherein the pixel circuit further comprises a light-emitting control unit; the light-emitting control unit is connected with a first voltage terminal, a first light-emitting control terminal, and a first light-emitting control node;

the driving method further comprises executing operations as follows within the first time period of the Nth frame and the second time period of the Nth frame, respectively;

controlling the light-emitting control unit by a signal of the first light-emitting control terminal, to conduct the first voltage terminal and the first light-emitting control node, and to output a voltage level of the first voltage terminal to the first light-emitting control node;

the driving method further comprises executing operations as follows within the first time period of the (N+1)th frame:

controlling the light-emitting control unit by the signal of the first light-emitting control terminal, to disconnect the first voltage terminal from the first light-emitting control node; and the driving method further comprises executing operations as follows within the second time period of the (N+1)th frame;

controlling the light-emitting control unit by the signal of the first light-emitting control terminal, to conduct the first voltage terminal and the first light-emitting control node, and to output the voltage level of the first voltage terminal to the first light-emitting control node.

16. The driving method according to claim 13, wherein the second sub-pixel circuit further includes a second data input unit and a second storage capacitor:

the driving method further comprises executing operations as follows within the first time period of the Nth frame, the second time period of the Nth frame, the first time period of the (N+1)th frame and the second time period of the (N+1)th frame, respectively:

controlling the second data input unit by the signal of the scanning terminal, to conduct the second data terminal and the second sub-pixel node, and to transmit a second data signal of the second data terminal to the second sub-pixel node; and storing a voltage level between the second sub-pixel node and the first voltage terminal by the second storage capacitor.

17. The driving method according to claim 13, wherein the pixel circuit further comprises a light-emitting control unit; and the light-emitting control unit is connected with a first voltage terminal, a second light-emitting control terminal, and a second light-emitting control node;

the driving method further comprises executing operations as follows within the first time period of the Nth frame:

controlling the light-emitting control unit by a signal of the second light-emitting control terminal, to disconnect the first voltage terminal from the second light-emitting control node;

the driving method further comprises executing operations as follows within the second time period of the Nth frame:

controlling the light-emitting control unit by the signal of the second light-emitting control terminal, to conduct the first voltage terminal and the second light-emitting control node and to transmit a voltage level of the first voltage terminal to the second light-emitting control node;

the driving method further comprises executing operations as follows within the first time period of the (N+1)th frame and the second time period of the (N+1)th frame, respectively:

controlling the light-emitting control unit by the signal of the second light-emitting control terminal, to conduct the first voltage terminal and the second light-emitting control node and to transmit the voltage level of the first voltage terminal to the second light-emitting control node.

18. The driving method according to claim 13, wherein the pixel circuit further comprises a second reverse bias unit; and the second reverse bias unit is connected with a second bias output node, a first bias output node, a first light-emitting control terminal, a second light-emitting control terminal, and a second voltage terminal;

the driving method further comprises executing operations as follows within the first time period of the Nth frame:

controlling the second reverse bias unit by a signal of the first light-emitting control terminal, to conduct the second voltage terminal and the second bias output node, and to output a voltage level of the second voltage terminal to the second bias output node;

controlling the second reverse bias unit by a signal of the second light-emitting control terminal, to disconnect the second voltage terminal from the first bias output node;

the driving method further comprises executing operations as follows within the second time period of the Nth frame:

controlling the second reverse bias unit by the signal of the first light-emitting control terminal, to conduct the second voltage terminal and the second bias output node, and to output the voltage level of the second voltage terminal to the second bias output node; and controlling the second reverse bias unit by the signal of the second light-emitting control terminal, to conduct the second voltage terminal and the first bias output node, and to output the voltage level of the second voltage terminal to the first bias output node;

the driving method further comprises executing operations as follows within the first time period of the (N+1)th frame:

controlling the second reverse bias unit by the signal of the first light-emitting control terminal, to disconnect the second voltage terminal from the second bias output node;

controlling the second reverse bias unit by the signal of the second light-emitting control terminal, to conduct the second voltage terminal and the first bias output node, and to output the voltage level of the second voltage terminal to the first bias output node; and the driving method further comprises executing operations as follows within the second time period of the (N+1)th frame:

controlling the second reverse bias unit by the signal of the first light-emitting control terminal, to conduct the second voltage terminal and the second bias output node, and to output the voltage level of the second voltage terminal to the second bias output node; and controlling the second reverse bias unit by the signal of the second light-emitting control terminal, to conduct the second voltage terminal and the first bias output node, and to output the voltage level of the second voltage terminal to the first bias output node.

19. A driving method of a pixel circuit, the pixel circuit comprising a first reverse bias unit, and a first sub-pixel circuit and a second sub-pixel circuit adjacent to each other, wherein the first sub-pixel circuit comprises a first light-emitting unit, and the second sub-pixel circuit comprises a second light-emitting unit;

the light-emitting unit is connected with a first drive node, the second light-emitting unit is connected with a first bias output node;

the first reverse bias unit is connected with the first drive node, the first bias output node, and a first bias control terminal;

the first light-emitting unit is configured to emit light under control of a first driving signal, and to output the first driving signal to the first drive node;

the first reverse bias unit is configured to output the first driving signal of the first drive node to the first bias output node, under control of the first bias control terminal; and the first bias output node is configured to supply a reverse bias voltage to the second light-emitting unit;

wherein the driving method comprises:

executing operations as follows within a first time period of an Nth frame:

controlling a first light-emitting unit of a first sub-pixel circuit to emit light by a first driving signal;

controlling a first reverse bias unit by a first bias control terminal, to conduct a first drive node and a first bas output node, and to transmit the first driving signal of the first drive node to the first bias output node; and controlling the first reverse bias unit by a second bias control terminal, to conduct a second drive node and a second bias output node; and executing operations as follows within a second time period of the Nth frame:

controlling a second light-emitting unit of a second sub-pixel circuit to emit light by a second driving signal;

controlling the first reverse bias unit by the second bias control terminal, to conduct the second drive node and the second bias output node, and to transmit the second driving signal of the second drive node to the second bias output node; and controlling the first reverse bias unit by the first bias control terminal, to conduct the first drive node and the first bias output node.

20. The driving method according to claim 19, wherein the first sub-pixel circuit further includes a first data input unit and a first storage capacitor;

the driving method further comprises executing operations as follows within the first time period of the Nth frame and the second time period of the Nth frame, respectively:

controlling the first data input unit by a signal of the scanning terminal, to conduct the first data terminal and a first sub-pixel node, and to transmit a first data signal of the first data terminal to the first sub-pixel node; and storing a voltage level between the first stab-pixel node and the first voltage terminal by the first storage capacitor.

21. The driving method according to claim 19, wherein the pixel circuit further comprises a light-emitting control unit; and the light-emitting control unit is connected with a first voltage terminal, a first light-emitting control terminal, and a first light-emitting control node;

the driving method further comprises executing operations as follows within the first time period of the Nth frame:

controlling the light-emitting control unit by a signal of the first light-emitting control terminal, to conduct the first voltage terminal and the first light-emitting control node, and to output a voltage level of the first voltage terminal to the first light-emitting control node; and the driving method further comprises executing operations as follows within the second tune period of the Nth frame:

controlling the light-emitting control unit by the signal of the first light-emitting control terminal, to disconnect the first voltage terminal from the first light-emitting control node.

22. The driving method according to claim 19, wherein the second sub-pixel circuit further includes a second data input unit and a second storage capacitor;

the driving method further comprises executing operations as follows within the first time period of the Nth frame and the second time period of the Nth frame, respectively:

controlling the second data input unit by the signal of the scanning terminal, to conduct the second data terminal and the second sub-pixel node, and to transmit a second data signal of the second data terminal to the second sub-pixel node; and storing a voltage level between the second sub-pixel node and the first voltage terminal by the second storage capacitor.

23. The driving method according to claim 19, wherein the pixel circuit further comprises a light-emitting control unit; the light-emitting control unit is connected with a first voltage terminal, a second light-emitting control terminal, and a second light-emitting control node;

the driving method further comprises executing operations as follows within the first time period of the Nth frame:

controlling the light-emitting control unit by a signal of the second sight-emitting control terminal, to disconnect the first voltage terminal from the second light-emitting control node; and the driving method further comprises executing operations as follows within the second time period of the Nth frame:

controlling the light-emitting control unit by the signal of the second light-emitting control terminal, to conduct the first voltage terminal and the second light-emitting control node and to transmit a voltage level of the first voltage terminal to the second light-emitting control node.

* * * * *